US006242166B1

(12) United States Patent
Irving et al.

(10) Patent No.: US 6,242,166 B1
(45) Date of Patent: Jun. 5, 2001

(54) PACKAGED COLOR PHOTOGRAPHIC FILM COMPRISING A BLOCKED PHENYLDIAMINE CHROMOGENIC DEVELOPER

(75) Inventors: Mark E. Irving; Richard P. Szajewski; Lyn M. Irving, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/475,510

(22) Filed: Dec. 30, 1999

(51) Int. Cl.[7] ..... G03C 7/18; G03C 7/32; G03C 7/388; G03C 7/413

(52) U.S. Cl. ..... 430/351; 430/21; 430/363; 430/364; 430/380; 430/543; 430/566; 430/959

(58) Field of Search ..... 430/351, 380, 430/959, 21, 364, 543, 363, 566

(56) References Cited

U.S. PATENT DOCUMENTS

| | | | | |
|---|---|---|---|---|
| 4,157,915 | * | 6/1979 | Hamaoka et al. | 430/959 |
| 4,789,623 | * | 12/1988 | Sato et al. | 430/351 |
| 5,618,656 | | 4/1997 | Szajewski et al. | 430/380 |
| 5,989,789 | | 11/1999 | Nakagawa et al. | 430/382 |
| 6,013,420 | * | 1/2000 | Wingender et al. | 430/351 |
| 6,030,755 | * | 2/2000 | Matsumoto et al. | 430/351 |

FOREIGN PATENT DOCUMENTS

| | | |
|---|---|---|
| 0 762 201 A1 | 3/1997 | (EP) . |
| 10-78638 | 3/1998 | (JP) . |

* cited by examiner

*Primary Examiner*—Richard L. Schilling
(74) *Attorney, Agent, or Firm*—Chris P. Konkol

(57) ABSTRACT

This invention relates to packaged photographic film that is capable of being alternately processed, according to individual consumer choice, by either (1) a traditional wet-chemistry process with a phenylenediamine-containing developer solution followed by desilvering in one or more subsequent solutions to obtain a color negative film, or (2) a thermal process involving the use of a relatively minor amount of an aqueous solution containing a liberating agent such as alkaline base to activate (unblock) a blocked phenylenediamine developing agent located within the photographic element, followed by electronic scanning of the developed film without desilvering. This invention enables a single film stock to be developed in both a conventional deep tank process and in an apparently dry process.

19 Claims, 2 Drawing Sheets

PACKAGED COLOR PHOTOGRAPHIC FILM COMPRISING A BLOCKED PHENYLDIAMINE CHROMOGENIC DEVELOPER

FIELD OF THE INVENTION

This invention relates to a packaged film and a method of processing the film such that, after imagewise exposure, the film is capable of being color developed either (1) by sequential immersion of the film in a wet-chemical multi-tank process at a temperature of 50° C. or less by immersion in a phenylenediamine-containing developer solution followed by desilvering in one or more subsequent solutions, to obtain a color negative film with the silver and silver halide removed from the film, or alternatively, (2) by thermal treatment by heating the film, at a temperature greater than 50° C. in a low-volume aqueous chemical base or acid to unblock and activate a blocked phenylenediamine developing agent located within the photographic film, followed by electronic scanning of the color film negative with the silver and silver-halide not removed from the film.

BACKGROUND OF THE INVENTION

With the remarkable advances in the fields of solid-state imaging devices and various hard-copy printing technologies made in recent years, the comparison between electronic imaging systems and the silver-halide photographic system has become a frequent subject of discussion. Nevertheless, the superiority of the silver halide photographic system with respect to high sensitivity and high image quality, particularly with respect to affordable consumer products, will not be threatened for some time in the future. One particular shortcoming of the silver-halide system, however, in comparison to electronic imaging systems is that the photographic element requires a so-called wet-development process that typically requires substantial volumes of solutions such as developing, fixing, and bleaching solutions. For the people engaged in the development of silver-halide photographic techniques, the development of a "dry" or "apparently dry" development process for the silver-halide color photographic system has been a goal for many years. By "apparently dry" is meant that a small or minimal amount of water or alkaline water may be added to a film to develop it, but that the conventional series of tanks, including complex chemicals, may be avoided.

A dry or apparently dry development process can be accomplished by the use of photothermographic elements described in Research Disclosure 17029 (Research Disclosure I). Generally, in these kinds of systems, development occurs by reduction of silver ions in the photosensitive silver halide to metallic silver as in conventional non-thermal systems, but the developing agent is contained within the element, so that it is unnecessary to immerse the photographic element in an aqueous solution containing a developing agent. Various types of photothermographic elements have been proposed and patented. Research Disclosure I discloses a type A and a B photothermographic system. Type A elements contain in reactive association a photosensitive silver halide, a reducing agent or developing agent, an activator, and a coating vehicle or binder. A problem has been to achieve a commercially viable system that produces a quality of image comparable, in the eyes of the average film consumer, to traditional silver-halide film.

A practical color photothermographic system for general use with respect to consumer cameras would have significant advantages. Such film might be amenable to development at kiosks, with the use of simple dry or apparently dry equipment. Thus, it is envisioned that a consumer could bring an imagewise exposed photothermographic film, for development and printing, to a kiosk located at any one of a number of diverse locations, optionally independent from a wet-development lab, where the film could be developed and printed without any manipulation by third-party technicians. It is also envisioned that a consumer might be more prone to owning and operating such film development equipment in a home, particularly if it was dry or apparently dry and did not involve the use of complex chemicals. Thus, the development of a successful photothermographic system could open up new opportunities for greater convenience and speed of development, even immediate development in the home for a wider cross-section of consumers.

In order to maintain the dry or apparently dry aspect of a photothermographic system, various possibilities exist. One, for example, is to fix/bleach (remove the silver and silver halide) in effect by a diffusion transfer. See, for example EP 0762 201 to Matsumoto et al assigned to Fuji Photo Film Co. With the advance of scanning technologies, it has now become natural and practical for photothermographic color film to be scanned, which can be accomplished without the necessity of removing the silver or silver-halide from the negative, although special arrangements for such scanning can be made to improve its quality. See, for example, Simmons U.S. Pat. No. 5,391,443.

It would be desirable if a photothermographic system could be made backwards compatible for use with a conventional wet-development process. Applicants have found that known photothermographic systems are not adaptable or readily adaptable for backwards compatibility. Applicants have found serious obstacles to obtaining a photothermographic system that is backwards compatible. For example, type B photothermographic systems, in which an organic silver salt plays the role of a silver ion source but does not function as the photosensor and memory, was not found not to be readily backwards compatible because of the antifoggants typically contained in such film. Photothermographic systems in which the developing agent is unblocked have also presented problems for backwards compatibility. For example, certain unblocked developing agents in the form of metal salt were found to prevent proper hardening of the silver-halide emulsion during manufacture.

Japanese kokai patent publication 10-78638 (Mar. 24, 1998) claims the use of a color photographic element that is backwards compatible by means of using a special combination of two yellow dye couplers with an unblocked ballasted sulfonamidophenol or sulfonyl hydrazide type developing agent. The pair of yellow dye couplers consist of one having a detachable cationic group and one having a detachable anionic group, the latter coupler preferably also containing a dye suppressant. It was found that, in the absence of one of the couplers, the color sensitivity during conventional wet-development was relatively poor, and that in the absence of the other of the two couplers, the granularity during conventional wet-development was relatively poor. As mentioned above, the photothermographic developing agent in Japanese kokai patent publication 10-78638 to Matsumoto et al was unblocked, and this fact may have adversely affected wet-development processing with conventional combinations of couplers and developing agents.

Another disadvantage of the ballasted sulfonamidophenol developing agents or ballasted sulfonylhydrazide developing agents in kokai 10-78638 is that they generally react with couplers to form dyes of low extinction or to form dyes which differ in hue from those formed with phenylenediamine color developing agents, resulting in unwanted color variations. This fact also limits the ability of the developed color negative image, after scanning, to provide visually editable and previewable images.

Blocked developing agents have been disclosed not only for use in photothermographic systems, but for use in non-thermal systems in which they may supplement an externally supplied developing agent. It is known that such developing agents can be introduced into a silver-halide emulsion in blocked form so that deleterious desensitization or fog effects that might otherwise occur due to the presence of such compounds in the film are eliminated. Such developing agents can be made to unblock under conditions of development so that the developing agent is free to participate in image-forming (dye or silver metal forming) reactions.

In these cases, the presence of blocked developing agents may be for providing development in one or more color records of the element, supplementary to the development provided by the developing agent in the processing solution to give improved signal in a shorter time of development or with lowered laydowns of photographic materials, or to give balanced development in all color records.

U.S. Pat. No. 3,342,599 to Reeves discloses the use of Schiff-base precursors of developing agents. Schleigh and Faul, in a Research Disclosure 9129 (1975) pp. 27–30), describes the acetamido blocking of p-phenylenediamines. Subsequently, U.S. Pat. No. 4,157,915, to Hamaoka et al and U.S. Pat. No. 4, 060,418, to Waxman and Mourning describe the preparation and use of carbamate blocked p-phenylenediamines in an image receiving sheet for color diffusion transfer.

Compounds having "β-ketoester" type blocking groups (strictly, β-ketoacyl blocking groups) are described in U.S. Pat. No. 5,019,492. With the advent of the β-ketoester blocking chemistry, it has become possible to incorporate p-phenylenediamine developing agents in film systems in a form from which they only become active when required for development. The β-ketoacyl blocked developing agents are released from the film layers in which they are incorporated by an alkaline developing solution containing a dinucleophile, for example hydroxylamine.

The incorporation of these blocked developing agents in photographic elements is typically carried out using colloidal gelatin dispersions of the blocked developing agents. These dispersions are prepared using means well known in the art, wherein the developing-agent precursor is dissolved in a high vapor pressure organic solvent (for example, ethyl acetate), along with, in some cases, a low vapor pressure organic solvent (such as dibutylphthalate), and then emulsified with an aqueous surfactant and gelatin solution. After emulsification, usually done with a colloid mill, the high vapor pressure organic solvent is removed by evaporation or by washing, as is well known in the art.

In order to be acceptable for commercial application, it is necessary that a blocked developing agent be stable before exposure, to avoid desensitizing the silver halide during storage, resulting in increased fog and/or decreased Dmax after development. At the same time, the blocked developing agent must be capable of sufficiently fast unblocking kinetics when the exposed film is being developed. In the case of the same photothermographic film designed for alternatively (at the discretion of the consumer) traditional wet-processing or apparently-dry thermal processing, it is surmised that another requirement might be that the blocked developing agent and/or its associated components not adversely affect or interfere with obtaining the results otherwise achieved by traditional wet-processing.

PROBLEM TO BE SOLVED BY THE INVENTION

A photothermographic color film, in which a silver-halide-containing color photographic element after image-wise exposure can be developed merely by the external application of heat and relatively small amounts of alkaline or acidic water, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of applying alkaline or acidic aqueous solution, in relatively very small amounts at a developing station. Color development and subsequent scanning of such a film could readily occur on an individual consumer basis, with the option of generating a display element corresponding to the developed color image.

SUMMARY OF THE INVENTION

The invention uses a color photographic film element comprising a support bearing at least three light-sensitive silver-halide emulsion units each having in reactive association at least one dye-forming coupler and a blocked phenylenediamine color developing agent. In addition to heat, a liberating agent chosen from the group consisting of acid or base, alone or in combination with another activating agent, in a small amount of water, can be used convert the latent color-developing agent to reactive form. The photographic element is a multilayer, multicolor element having red, green and blue color recording units each formed from like light sensitive layers respectively having cyan dye-forming, magenta dye-forming and yellow dye-forming couplers. In all cases, the latent phenylenediamine color developing can be in the same layer as a light-sensitive emulsion or it can be in a light insensitive layer. This photographic film is designed to enable a single film stock to be developed in either (1) a conventional wet-chemical process, for example a C-41 deep-tank process, or (2) an apparently dry process. For example, an individual consumer, at his or her discretion, could potentially take the film to a kiosk to be thermally developed, or alternatively, submit the film to a wet-processing lab. Thus, depending on various factors, including the availability of thermal processing facilities in a given geography over a give period of time, it can be expected that, a portion of such film will, in fact, be developed by a conventional wet-chemical process, and a portion of such film will be developed by a thermal process.

In one embodiment of the present invention, a packaged photographic film element has at least three light-sensitive layers which have their individual sensitivities in different wavelength regions, each of the layers comprising a light-sensitive silver-halide emulsion, a binder, a dye-providing coupler, and a blocked phenylenediamine developing agent. The package (inclusive of its package insert) includes indicia indicating that the consumer may direct the film to be alternatively processed and developed in either of two routes. These two routes correspond (at least in fact by means of consumer processing selection, if not explicity stated) to (1) a conventional wet-chemical processing, for example, a C-41 process, and (2) a thermal process utilizing low-volume aqueous solutions not containing an externally applied developing agent.

DETAILED DESCRIPTION OF THE INVENTION

Figure 1:
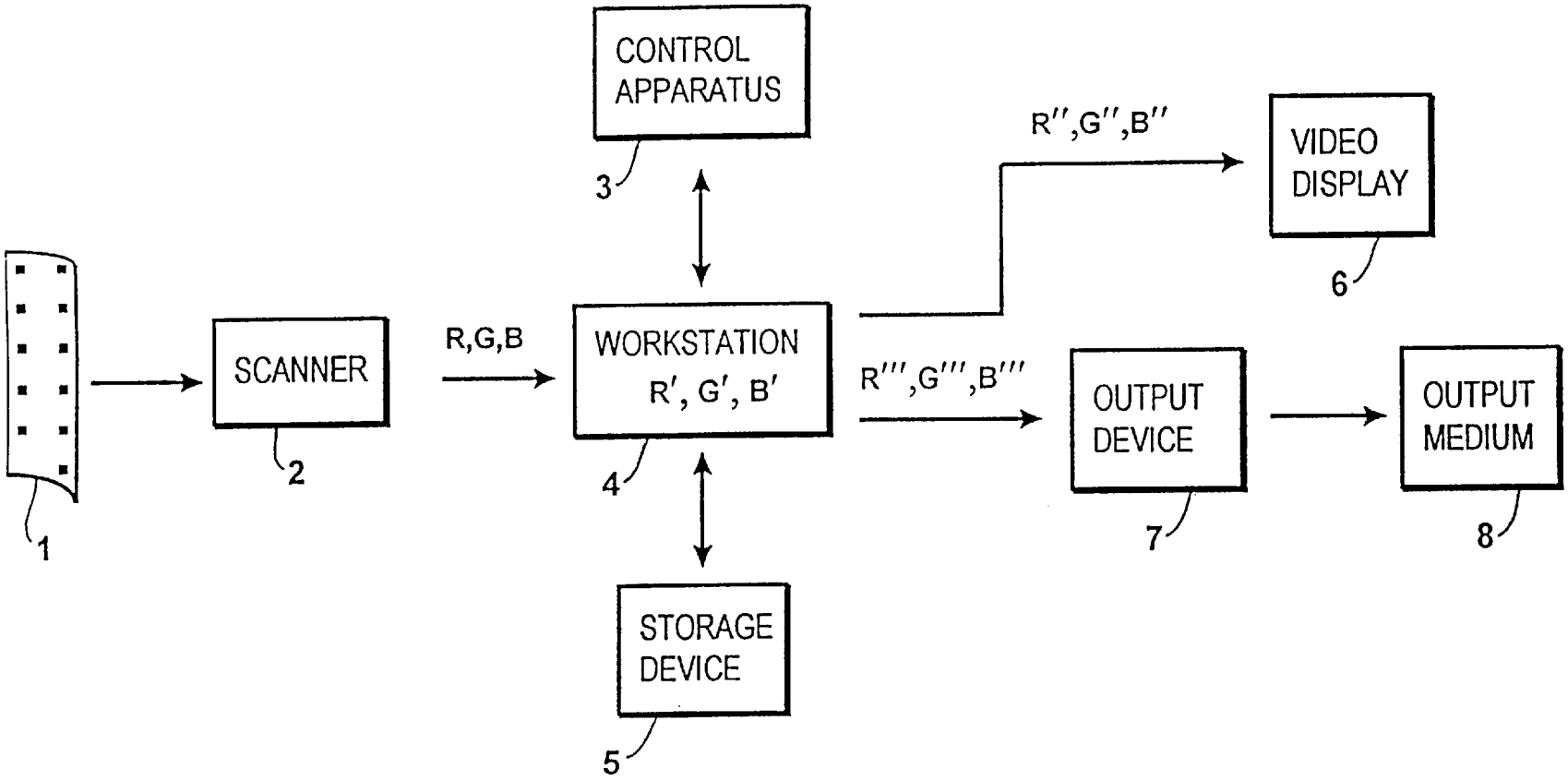
FIG. 1 shows in block diagram form an apparatus for processing and viewing image formation obtained by scanning the elements of the invention.

As mentioned above, the present invention is directed to a packaged silver-halide-containing color photographic element that is capable of being alternatively developed in either of two diverse ways, either a thermal process involving only internally supplied developing agent or a traditional kind of wet-chemical process involving a sufficient amount of externally supplied developing agent for complete development.

By "traditional kind of wet-chemical processing" or, synonomously, "wet-chemical processing" is herein meant herein a commercially standardized process in which the imagewise exposed color photographic element is completely immersed in a solution containing a phenylenediamine developing agent, under agitation at a temperature of under 50° C., preferably 30 to 45° C., in order to form a color image from a latent image, wherein said developer solution comprises an unblocked developing agent that is a phenylenediamine compound which compound (after oxidation) forms dyes by reacting with the dye-providing couplers inside the silver-halide emulsions.

By "low-volume thermal process" or, synonomously, "apparently-dry thermal process" or "thermal process" is herein meant a process involving the use of heat to raise the temperature of the photothermographic element or film to a temperature above 50° C. under (preferably alkaline or acidic) aqueous conditions such that the blocked developing agent in the photothermographic element becomes unblocked to form the a phenylenediamine compound, preferably the same as is the non-blocked phenylenenediamine developing agent used in the alternative wet-chemical process, whereby the unblocked developing agent can form a color negative image from a latent image in the film, which color negative image can be scanned without desilvering (for example, without fixing or bleaching), to provide a digital electronic record corresponding to the color negative image. The digital electronic record can optionally be used (immediately or later) to provide a color positive image in a display element, for example, by thermal-diffusion printing, ink-jet printing, or the like. Typically, as described below, the volume of aqueous solution utilized in the low-volume thermal process is relatively less than the volume of aqueous solution utilized in the alternative the wet-chemical process.

One aspect of the invention is directed to a method of processing an imagewise exposed color photographic element such as described above, which method comprises contacting the imagewise exposed color photographic element with a developer solution containing phenylenediamine developing agent, under agitation at a temperature of 50° C. or less, preferably 30 to 45° C., in order to form a color negative image from a latent image, wherein the oxidized form of the phenylenediamine developing agent forms dyes by reacting with the dye-providing couplers of a photographic element such as a multilayer pack. The dyes formed from the dye-providing couplers in the three light-sensitive units of the multilayer pack are different in hue. The film element is then desilvered, for example bleached and fixed, to remove unwanted silver and silver halide, thereby forming a color negative film capable of use to make a positive-image print. The internally located blocked developing agent in the three light-sensitive units, intended for the optional alternative thermal development, does not interfere with the wet-chemical processing.

The invention is also directed to a packaged article of manufacture comprising a photographic element having an internally located blocked developing agent in reactive association with the light-sensitive units such that the imagewise exposed photographic element is capable of being developed without any externally supplied developing agent, merely by heating to raise the temperature of the photographic element to a temperature above 50° C., preferably above 60° C., under (optionally alkaline or acidic) aqueous conditions, such that the blocked developing agent becomes unblocked to form a phenylenediamine developing agent, whereby the unblocked developing agent can form a color negative image from a latent image, which color negative image optionally may be scanned, without desilvering the developed photographic element, to provide a digital electronic record corresponding to a color image for later transfer to a display element.

According to another aspect of the invention, a comparative photographic element (I) and the inventive photographic element (II) produce substantially identical density deposits when imagewise exposed to a common graduated density test target and commonly developed according to a specified development process (Process I described below). Photographic element (I) comprises a support bearing a layer unit sensitive to a region of the electromagnetic spectrum which layer unit comprises a binder, and a light sensitive silver halide emulsion. Photographic element (II) is like photographic element (I) except that the layer unit additionally comprises in reactive association a developing-agent precursor that becomes unblocked during thermal development processing. By substantially identical density deposits is meant that: first, the $\lambda$max of the density deposits are in the ratio of 0.9 to 1.1 and preferably in the ratio of 0.95 to 1.05 and more preferably in the ratio of 0.97 to 1.03; and second, that the gammas at that $\lambda$max are in the ratio of 0.8 to 1.2, and preferably in the ratio of 0.9 to 1.1 and more preferably in the ratio of 0.95 to 1.05. The specified development process (Process 1) is one carried out by contacting the elements with a developer solution for 195 seconds, where the developer solution is at a temperature of 37.6 ° C., a pH of 10 and comprises 4.5 g/L of 4-amino-3-methyl-N-ethyl-N-(2-hydroxyethyl)aniline sulfate. It will be appreciated that the term substantially identical effectively means that the comparative and inventive element after the prescribed exposure and development processing form density deposits having a $\lambda$max within 10%, preferably within 5% and more preferably with 3% of each other. It will be further appreciated that the comparative and inventive element after the prescribed exposure and development processing form density deposits having a Dmax and a gamma at that $\lambda$max within 20%, preferably within 10% and more preferably with 5% of each other.

One preferred embodiment the layer unit of the inventive element comprises in reactive association a chromogenic coupler that can react with the oxidized form of a color developing agent to form a colored dye density deposit and produces substantially identical density deposits according to the aforesaid test and criteria.

In another preferred embodiment the inventive photographic element comprises a red sensitive layer unit, a green sensitive layer unit and a blue sensitive layer unit, each of which comprises in reactive association a chromogenic coupler that can react with the oxidized form of a color developing agent to imagewise form distinctly colored dye density deposits. Here, each dye deposit is preferably substantially identical according to the aforesaid test and criteria. The imagewise-formed dye deposits can preferably be cyan, magenta and yellow colored dye deposits. Other layer sensitivities and mixed dye deposits can be employed as known in the art.

In yet another preferred embodiment the layer order arrangement, sensitization scheme and image processing scheme disclosed by Arakawa et al. at U.S. Pat. No. 5,962,205, the disclosures of which are incorporated by reference, can be employed.

In another embodiment, a panchromatic or white light sensitive layer unit can be employed so as to be imagewise exposed through a colored filter array as known in the art.

By red sensitive is meant sensitivity to light in the 600 to 700 nm region of the electromagnetic spectrum. By green sensitive is meant sensitivity to light in the 500 to 600 nm region of the electromagnetic spectrum. By blue sensitivity is meant sensitivity to light in the 400 to 500 nm region of the electromagnetic spectrum. By pan-chromatic or white sensitivity is meant sensitivity to light in the 400 to 700 nm region of the electromagnetic spectrum.

A photographic element according to the present invention, comprising a support bearing a layer unit sensitive to a region of the electromagnetic spectrum which layer unit comprises a binder, a light sensitive silver-halide emulsion, and in reactive association, a developing-agent precursor that becomes unblocked during thermal processing. When thermal development (Processing II) is carried out, the thermally processed product (the developed film), according to the specified process parameters for the film, preferably exhibits a differential density in each record after scanning, a useful exposure latitude of at least 2.7 log E, and a $D_{min}$ less than 4.0. This would apply to three color records in a multilayer pack. More preferably, each record exhibits a gamma between 0.3 and 0.75, a $D_{min}$ less than 3.0, and an exposure latitude greater than 3.0 log E.

After imagewise exposure of the photographic element, the developing-agent precursor, in the presence of an optional acid or base, in an aqueous environment (in the absence of an external developing agent) at a temperature in excess of 50° C., releases a developing agent in reactive association with the silver-halide emulsion, thereby forming a first imagewise density deposit. The photographic element is further defined by herein alternatively contacting said element with a developer solution to form a second imagewise density deposit; said developer solution comprising a developing agent and having a pH greater than about 9; and said contacting occurring for between 10 and 500 seconds at a temperature below 50° C.; and wherein said second imagewise density deposit has substantially no density contribution [no more than 20% difference at $\lambda_{max}$] formed by release of a develop agent by said developing-agent precursor.

Another aspect of the invention is directed to a method of processing a commercial quantity of color photographic film sold to camera users over a given period of time, which film has been imagewise exposed in a camera, said film having at least three light-sensitive units which have their individual sensitivities in different wavelength regions, each of the units comprising at least one light-sensitive silver-halide emulsion, binder, and dye-providing coupler. The commercial quantity involved will typically involved over one thousand rolls over a period of within 3 months to 1 year, more typically over one-hundred-thousand rolls of film, preferably. The geographical area, a contiguous area containing a plurality of kiosks for thermal film development, will involve greater than 10,000 persons, typically greater than 100,000 persons, preferably greater than 1,000,000 persons, and may involve politically determined geographical areas such as countries or divisions thereof, for example, counties, cities, states in the US, or comparable geographical entities in other countries. A geographical area is meant to include the place from where the film is actually submitted for development or the residence of the consumers submitting the film, rather than the place of film development, especially for film developed by a traditional wet-chemical process. Preferably, the commercial quantity of film developed according to the invention will eventually involve an entire state or country in which the developed film will be over one million rolls developed in a given quarter (three-month period) of the year. By the term "substantial portion" is meant at least 5% of rolls of film, according to the present invention, developed in the given time period, preferably at least 10%. Preferably at least 25 to 99%, more preferably at least 50 to 90% of the film rolls in a given area and time period will be developed by the thermal process.

Accordingly, a substantial portion of said quantity of film will be developed by each of two routes (Routes A and B, respectively). A first route (A), by which a substantial portion of said quantity of film will be processed, will involve a color development step without any externally applied developing agent, solely by heating said film to a temperature above about 50° C. under (preferably alkaline) aqueous conditions, such that an internally located blocked developing agent in reactive association with each of said three light-sensitive units becomes unblocked to form a phenylenediamine developing agent, whereby the unblocked developing agent is imagewise oxidized on development and this oxidized form reacts with the dye-providing couplers to form a dye and thereby a color negative image, which color image may be scanned, optionally without desilvering, to provide a digital electronic record of the color image capable of generating a positive color image in a display element. The printed color image may, for example, be generated by thermal-diffusion or ink-jet printing.

A second route (B) will involve a color development step comprising contacting the imagewise exposed color photographic film with a developing agent comprising a non-blocked p-phenylenediamine developing agent, under agitation at a temperature of 30 to 50° C. under aqueous alkaline conditions, in order to form a color negative image in the film by reaction of the non-blocked p-phenylenediamine developing agent with the dye-providing couplers, the dyes formed from the dye-providing couplers in the three light-sensitive units being different in hue, followed by desilvering said film in one or more desilvering solutions to remove unwanted silver and silver halide, thereby forming a color negative image; and thereafter forming a positive-image color print from the desilvered film.

Preferably, the development processing Route B is carried out (i) for from 60 to 220, preferably 150 seconds to 200 seconds, (ii) at the temperature of a color developing solution of from 35 to 40° C., and (iii) using a color developing solution containing from 10 to 20 mmol/liter of a phenylenediamine developing agent.

Preferably, the development processing Route A is carried out (i) less than 60 seconds, (ii) at the temperature from 50 to 95° C., and (iii) using an aqueous solution that is substantially free of a color developing agent.

In one embodiment of a method according to the present invention, the consumer who submits the film for development makes the choice of either color development route described above. The blocked developing agent, after being unblocked, may be the same compound as the non-blocked developing agent.

Indicia on the film package sold to the consumer can instruct or inform the consumer that the photographic film may be either (a) thermally developed at an automated kiosk that develops and scans the photographic film, before optionally printing it on a recording element, or alternatively, (b) developed in a wet-chemical process involving consecutively immersing the photographic film in multiple tanks, including at least one tank for developing the photographic film and at least one tank for desilvering the film. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence commercially transportable to diverse locations. Such kiosks may optionally comprise a heater for color development, a scanner for digitally recording the color image, and a device for transferring the color image to a display element.

In one embodiment of the invention, the alkaline or acidic conditions can be produced in the photographic element by means of a laminate that provides a source of externally supplied alkaline or acidic solution for diffusion transfer to the photographic element. Alternately, the alkaline or acidic solution can be provided to the photographic element undergoing color development by other methods, for example by spraying, immersion, gravure, coating, or by rollers, or other means known in the art. A source of chemical base or acid can be provided in the photographic element, such that the added water or other aqueous solution may be neutral or near neutral.

Thus, according to the present invention, the same photographic element can be developed by either of two alternative routes, either Route A or Route B, the choice of the route for a given roll of film preferably at the discretion of the consumer.

Route A: This route may be referred to as an apparently dry thermal process, wherein film processing is initiated by the combination of exposure to heat and contact with a processing solution, but where the processing solution volume is comparable to the total volume of the photographic layer to be processed and where the processing solution does not contain a developing agent. This type of system may include the addition of non-solution processing aids, such as the application of a laminate layer that is applied at the time of processing. After image-wise exposure of the photographic element, the blocked developing agent may be activated during processing of the photographic element by heating in the presence of acid or base in the processing solution.

Route B: This route may be referred to as a chemical wet-process, typically a commercially standardized process, in which the film elements are processed by contact with processing solutions, and the volume of such solutions is very large in comparison to the volume of the photographic layer.

Accordingly, when distributed to the consumer, the photographic element according to the present invention will be contained within a package including indicia indicating that the film may be processed and developed by either of two kinds of routes, which happen to correspond to (1) a wet-chemical process such as C-41 or the like, and (2) a thermal process, involve relatively small (low-volume) amounts of aqueous solution without externally applied developing agent.

Preferably, the package of the film indicates either implicity or explictly (to the consumer wishing to have the film developed) that the film, at the consumer's option, may be either (1) developed at an automated kiosk that thermally develops and scans the film, before optionally printing it on a paper material, or alternatively, (2) developed in a wet-chemical process, usually standardized to a large extent, involving consecutively immersing the photographic element in multiple tanks, including at least one tank for developing the photographic element and at least one tank for desilvering.

These two types of processing, Routes A and B, will now be described in more detail, beginning with Route A, the apparently-dry photothermographic process systems. After imagewise exposure of the photographic element (in fact, a photothermographic element by this route), the resulting latent image can be developed by heating the element to thermal processing temperature in the presence of a minimal amount (low volume) aqueous solution and optionally a pH activator. Preferably, low-volume processing involves processing where the volume of applied solution is between about 0.1 to about 20 times, more preferably about 0.5 to about 10 times, the volume of solution required to swell the photothermographic element. This heating merely involves heating the photothermographic element to a temperature within the range above 50° C., preferably about 60° C. to 160° C., until a developed image is formed, such as within about 0.5 to about 60 seconds. By increasing or decreasing the thermal processing temperature a shorter or longer time of processing is useful, and a lower or even zero amount of activator may be required. A more preferred thermal processing temperature is within the range of about 65° C. to about 90° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and the imageforming combination are in a location with respect to each other that enables the desired processing and forms a useful image. This may include the location of components in different layers.

The Route A photothermographic processing may involve some or all of the following treatments:

(1) Application of a solution directly to the film by any means, including spray, inkjet, coating, gravure process and the like.

(2) Soaking of the film in a shallow reservoir containing a processing solution. This process may also take the form of dipping or passing an element through a small cartridge.

(3) Lamination of an auxiliary processing element to the photographic element. The laminate may have the purpose of providing processing chemistry and/or removing spent chemistry. For example, the laminant may be a dry material applied to an already wet film or the laminant can be used to provide aqueous solution to dry film.

The heating of the element may be accomplished by any convenient means, including a simple hot plate, iron, roller, heated drum, microwave heating means, heated air, vapor, or the like. Heating may be accomplished before, during, after, or throughout any of the preceding treatments 1–3.

Scanning

The photothermographic element, following color development as discussed above, may serve as origination material for some of all of the following processes: image scanning to produce an electronic rendition of the capture image, and subsequent digital processing of that rendition to manipulate, store, transmit, output, or display electronically that image.

It is contemplated that the design of the processor for the photothermographic element can be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. Nos. 09/206,914 filed Dec. 7, 1998 and 09/333,092 filed Jun. 15, 1999, which are incorporated herein by reference.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No.

5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records—red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements in accordance with the invention are converted to digital form, manipulated, and recreated in a viewable form. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
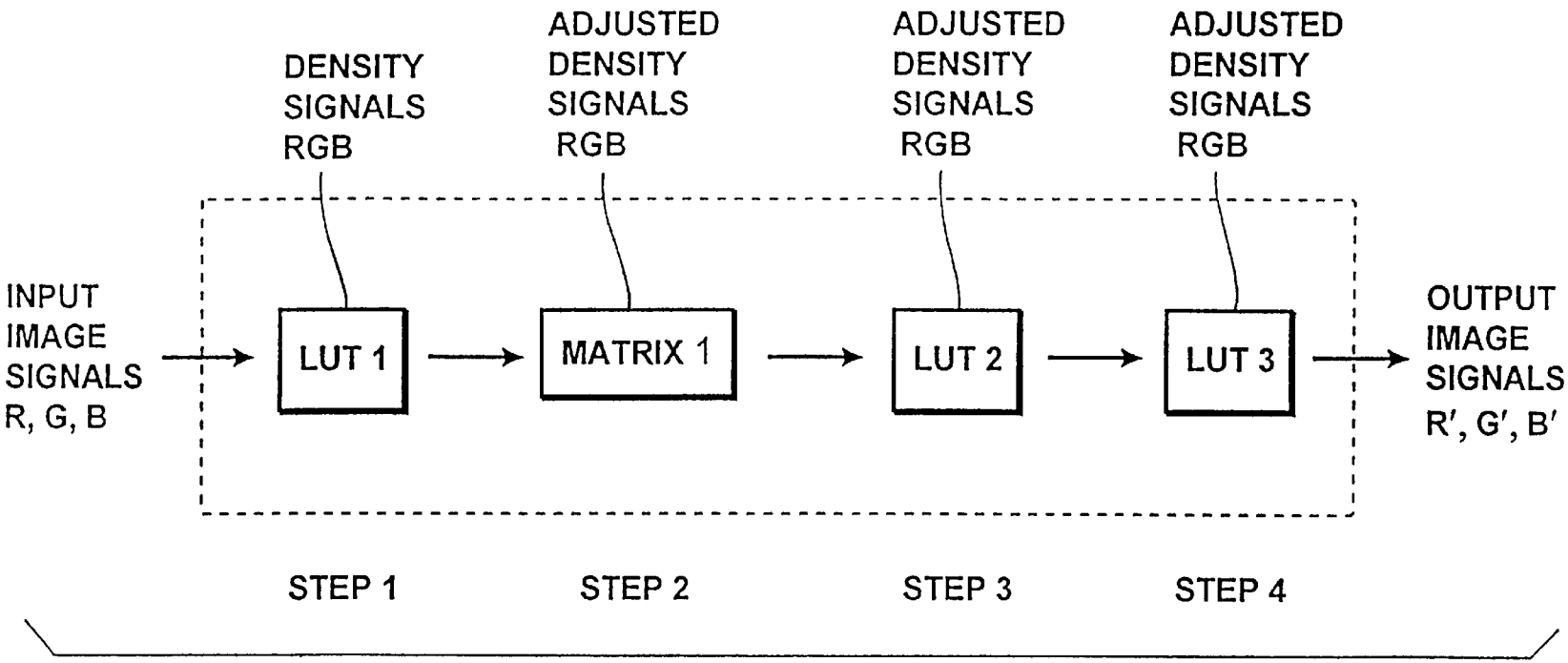
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred embodiment of the invention, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the usefull exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

The Route B process (wet-chemical process) will now be described in more detail. Photographic elements comprising the composition of the invention can be processed in any of a number of well-known photographic processes utilizing any of a number of well-known processing compositions, described, for example, in *Research Disclosure II*, or in T. H. James, editor, *The Theory of the Photographic Process*, 4th Edition, Macmillan, New York, 1977. The development process may take place for a specified length of time and temperature, with minor variations, which process parameters are suitable to render an acceptable image.

In the case of processing a negative working element, the element is treated with a color developing agent (that is one which will form the colored image dyes with the color couplers), and then with a oxidizer and a solvent to remove silver and silver halide. The developing agents are of the phenylenediamine type, as described below. Preferred color developing agents are p-phenylenediamines, especially any one of the following:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The color developer composition can be easily prepared by mixing a suitable color developer in a suitable solution. Water can be added to the resulting composition to provide the desired composition. And the pH can be adjusted to the desired value with a suitable base such as sodium hydroxide. The color developer solution for wet-chemical development can include one or more of a variety of other addenda which are commonly used in such compositions, such as antioxidants, alkali metal halides such as potassium chloride, metal sequestering agents such as aminocarboxylic acids, buffers to maintain the pH from about 9 to about 13, such as carbonates, phosphates, and borates, preservatives, development accelerators, optical brightening agents, wetting agents, surfactants, and couplers as would be understood to the skilled artisan. The amounts of such additives are well known in the art.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by desilvering, such as bleach-fixing, in a single or multiple steps, typically involving tanks, to remove silver or silver halide, washing and drying. The desilvering in a wet-chemical process may include the use of bleaches or bleach fixes. Bleaching agents of this invention include compounds of polyvalent metal such as iron (III), cobalt (III), chromium (VI), and copper (II), persulfates, quinones, and nitro compounds. Typical bleaching agents are iron (III) salts, such as ferric chloride, ferricyanides, bichromates, and organic complexes of iron (III) and cobalt (III). Polyvalent metal complexes, such as ferric complexes, of aminopolycarboxylic acids and persulfate salts are preferred bleaching agents, with ferric complexes of aminopolycarboxylic acids being preferred for bleach-fixing solutions. Examples of useful ferric complexes include complexes of:

nitrilotriacetic acid, ethylenediaminetetraacetic acid, 3-propylenediamine tetraacetic acid, diethylenetriamine pentaacetic acid, ethylenediamine succinic acid, ortho-diamine cyclohexane tetraacetic acid ethylene glycol bis(aminoethyl ether)tetraacetic acid, diaminopropanol tetraacetic acid, N-(2-hydroxyethyl)ethylenediamine triacetic acid, ethyliminodipropionic acid, methyliminodiacetic acid, ethyliminodiacetic acid, cyclohexanediaminetetraacetic acid glycol ether diamine tetraacetic acid.

Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.02 moles per liter of bleaching solution, with at least 0.05 moles per liter of bleaching solution being preferred. Examples of ferric chelate bleaches and bleach-fixes, are disclosed in DE 4,031,757 and U.S. Pat. Nos. 4,294,914; 5,250,401; 5,250,402; EP 567,126; 5,250,401; 5,250,402 and U.S. patent application Ser. No. 08/128,626 filed Sep. 28, 1993.

Typical persulfate bleaches are described in Research Disclosure, December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as Research Disclosure BL. Useful persulfate bleaches are also described in Research Disclosure, May, 1977, Item 15704; Research Disclosure, August, 1981, Item 20831; and DE 3,919,551. Sodium, potassium and ammonium persulfates are preferred, and for reasons of economy and stability, sodium persulfate is most commonly used.

A bleaching composition may be used at a pH of 2.0 to 9.0. The preferred pH of the bleach composition is between 3 and 7. If the bleach composition is a bleach, the preferred pH is 3 to 6. If the bleach composition is a bleach-fix, the preferred pH is 5 to 7. In one embodiment, the color developer and the first solution with bleaching activity may be separated by at least one processing bath or wash (intervening bath) capable of interrupting dye formation. This intervening bath may be an acidic stop bath, such as sulfuric or acetic acid; a bath that contains an oxidized developer scavenger, such as sulfite; or a simple water wash. Generally an acidic stop bath is used with persulfate bleaches.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, a bleaching solution may contain anti-calcium agents, such as 1-hydroxyethyl-1,1-diphosphonic acid; chlorine scavengers such as those described in G. M. Einhaus and D. S. Miller, Research Disclosure, 1978, vol 175, p. 42, No. 17556; and corrosion inhibitors, such as nitrate ion, as needed.

Bleaching solutions may also contain other addenda known in the art to be useful in bleaching compositions, such as sequestering agents, sulfites, non-chelated salts of aminopolycarboxylic acids, bleaching accelerators, re-halogenating agents, halides, and brightening agents. In addition, water-soluble aliphatic carboxylic acids such as acetic acid, citric acid, propionic acid, hydroxyacetic acid, butyric acid, malonic acid, succinic acid and the like may be utilized in any effective amount. Bleaching compositions may be formulated as the working bleach solutions, solution concentrates, or dry powders. The bleach compositions of this invention can adequately bleach a wide variety of photographic elements in 30 to 240 seconds.

Bleaches may be used with any compatible fixing solution. Examples of fixing agents which may be used in either the fix or the bleach fix are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used. The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing or bleach-fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The above mentioned bleach and fixing baths may have any desired tank configuration including multiple tanks, counter current and/or co-current flow tank configurations. A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Conventional techniques for processing are illustrated by Research Disclosure BL, Paragraph XIX.

Examples of how processing of a film according to the present invention in a wet-chemical process may occur are as follows:

(1) development→bleaching→fixing (2) development→bleach fixing (3) development→bleach fixing→fixing (4) development→bleaching→bleach fixing (5) development→bleaching→bleach fixing→fixing (6) development→bleaching→washing→fixing (7) development→washing or rinsing→bleaching→fixing (8) development→washing or rinsing→bleach fixing (9) development→fixing→bleach fixing

(10) development→stopping→bleaching→fixing

(11) development→stopping→bleach fixing

A photographic element according to the present invention, in order to enable option thermal precessing includes a blocked developing agent. The blocked develop er suitably releas es a phenyldiamine developing agent under thermal processing conditions while providing substantially no density to the image during alternate wet-chemical processing, for example, C-41 processing. A preferred blocked developer has the following group, wherein a linking group is attached to the 1-nitrogen of the aniline ring:

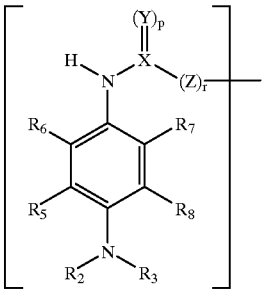

wherein $R_2$ and $R_3$ are independently hydrogen or a substituted or unsubstituted alkyl group or $R_2$ and $R_3$ are connected to form a ring. Substituents include, for example, hydroxy, halogen, halogenated alkyl, alkyl ether, alkylsulfonamido, sulfonamido groups, and other substitutions known in the art. The above structure includes the free base and neutral and photographically compatible salt forms thereof.

Furthermore, $R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring; and wherein X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0.

Illustrative linking groups include, for example,

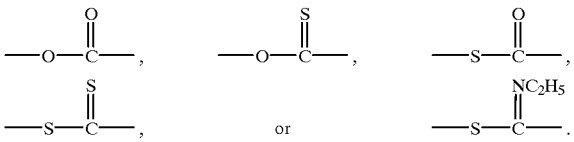

Preferably, the $t_{1/2}$ of the blocked developing agent is about 5.0 or less, preferably less than about 3.0 min, more preferably less than about 2 min, most preferably less than about 1.0, by the DMSO thermal stability test described in the examples below. The bond between the X and N atoms, in the above structure, provides a breakable linkage for unblocking of the developing agent during use.

More recently developed blocked developing agents are included in commonly assigned applications U.S. Ser. No. 09/475,690, Ser. No. 09/475,703, Ser. No. 09/476,233, Ser. No. 09/475,691, and Ser. No. 09/476,234, filed on the same day herewith, the disclosures of which are incorporated herein by reference in their entirety.

In any case, the developing agent, after unblocking should be a phenylenediamine compound, meaning the type of developing agent having two (para) substituted or unsubstituted amine groups on a six carbon aromatic ring, which compound preferably has the following structure:

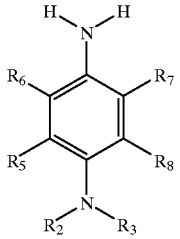

wherein $R_2$ and $R_3$ are independently hydrogen or a substituted or unsubstituted alkyl group or $R_2$ and $R_3$ are connected to form a ring. Substituents include, for example, hydroxy, halogen, halogenated alkyl, alkyl ether, alkylsulfonamido, sulfonamido groups, and other substitutions known in the art. The above structure includes the free base and neutral and photographically compatible salt forms thereof.

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring.

A variety of blocked phenylenediamine developing agents may be used in the present invention. The blocked developing agents should be selected so that the internal blocked developing agent does not react with dye-providing couplers in the photographic element during wet-chemical processing, for example during C-41 process conditions. Thus, the blocked developing agent should not competitively react with the dye-providing couplers inside the silver-halide emulsions during a C41 process or the like, before being washed out of the silver-halide emulsion. Preferably, during the C-41 process, less than 10 mole percent of the blocked developing agent reacts with the dye-providing couplers inside the silver-halide emulsions of the photographic element, preferably less than 5 mole percent. Typically the blocked developing agent is washed from the photographic element during wet-chemical processing.

For purposes of disclosing Applicants' best mode, an exemplary and preferred blocked developing agent will now be described, having the following structure I, in which the PUG is a dye-forming developing agent:

I

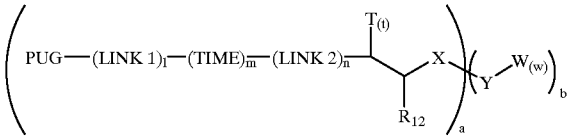

wherein:

PUG is a phenylenediamine developing agent;

LINK 1 and LINK 2 are linking groups;

TIME is a timing group;

l is 1;

m is 0, 1, or 2;

n is 0 or 1;

Y is C, N, O or S;

X is a substituted or unsubstituted aryl group or an electron-withdrawing group, for example, cyano, carbonyl, sulfoxy, sulfono, phosphoxy, and nitro;

W is hydrogen, halogen, or a substituted or unsubstituted alkyl (preferably containing 1 to 6 carbon atoms), cycloalkyl (preferably containing 4 to 6 carbon atoms), aryl (such as phenyl or naphthyl) or heterocyclic group, or W can combine with T or $R_{12}$ to form a ring, w is 0 to 3 when Y is C, w is 0–2 when Y is N, and w is 0–1 when Y is O or S, when w is 2, the two W groups can combine to form a ring, and when w is 3, two W groups can combine to form a ring or three W groups can combine to form an aryl group or a tricyclic substituent, for example the 1-adamantyl substituent;

$R_{12}$ is hydrogen, or a substituted or unsubstituted alkyl, cycloalkyl, aryl or heterocyclic group or $R_{12}$ can combine with T or W to form a ring;

T is a substituted or unsubstituted alkyl cycloalkyl, aryl or six-membered heterocyclic group, t is 0, 1, or 2, with the proviso that when X is a cyano or sulfono group, t is 1 or 2, when t is 2, the two T groups can combine to form a ring;

a is 1 or when X is divalent (for example, when X is carbonyl, sulfoxy, sulfono or phosphoxy), then a is 1 or 2; and b is 1 when X is divalent and 0 when X is monovalent.

Each alkyl group preferably contains 1 to 6 carbon atoms, each cycloalkyl group preferably contains 4 to 6 carbon atoms and each phenyl group preferably is phenyl or naphthyl.

In an even more preferred embodiment of the invention, LINK 1 and LINK 2 are of structure II:

II

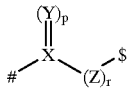

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

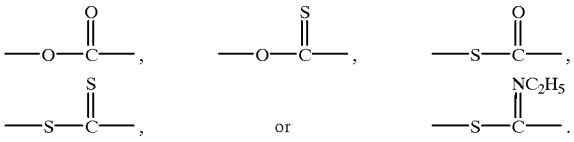

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (46) groups using an intramolecular nucleophilic substitution reaction (U.S. Pat. No. 4,248,962).

Illustrative timing groups are illustrated by formulae T-1 through T-4.

T-1

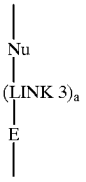

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

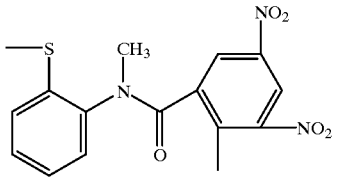

and

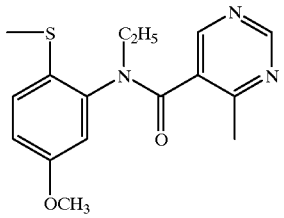

These timing groups are described more fully in U.S. Pat. No. 5,262,291, incorporated herein by reference.

T-2

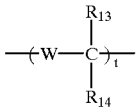

wherein

V represents an oxygen atom, a sulfur atom, or an

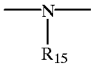

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

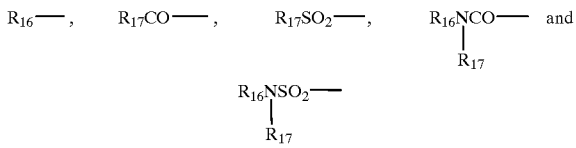

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

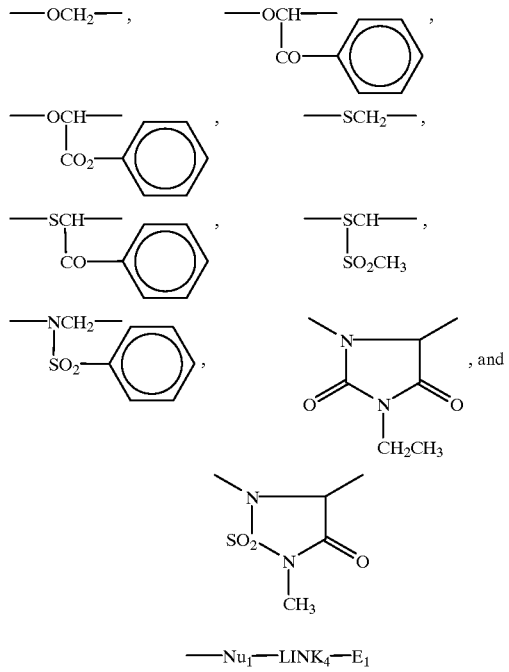

T-3 wherein $Nu_1$ represents a nucleophilic group, and an oxygen or sulfur atom can be given as an example of nucleophilic species; $E_1$ represents an electrophilic group being a group which is subjected to nucleophilic attack by Nu; and $Link_4$ represents a linking group which enables $Nu_1$ and $E_1$ to have a steric arrangement such that an intramolecular nucleophilic substition reaction can occur. Specific examples of the group represented by formula (T-3) are illustrated below.

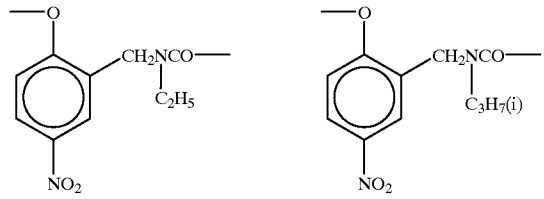

-continued

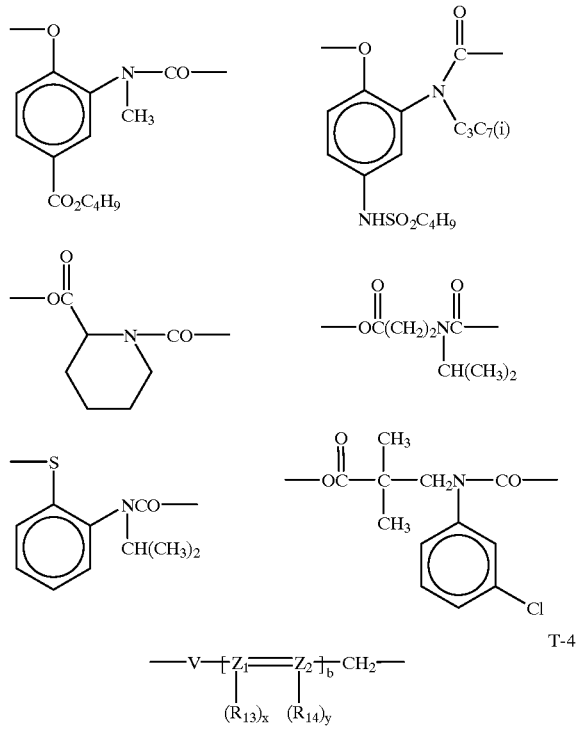

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

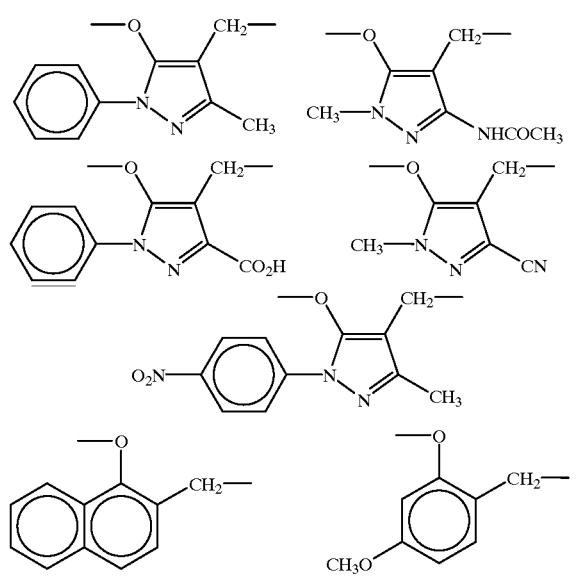

-continued

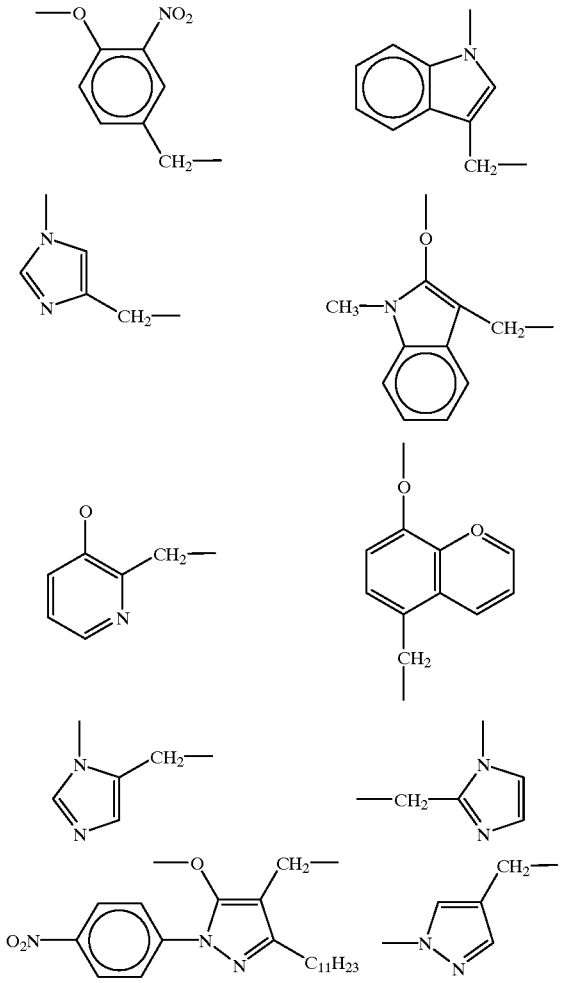

Particularly preferred photographically useful compounds are blocked developing agents of Structure III:

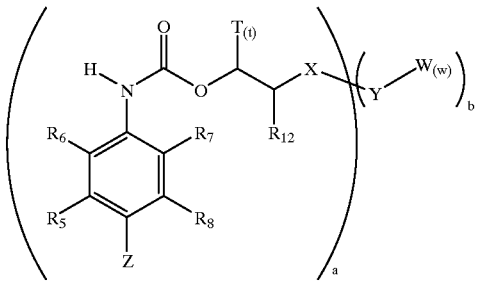

III wherein:

Z is $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring;

T is a substituted or unsubstituted alkyl cycloalkyl, aryl or six-membered heterocyclic group, t is 0, 1, or 2, with the proviso that when X is a cyano or sulfono group, t is 1 or 2, when t is 2, the two T groups can combine to form a ring;

$R_{12}$ is hydrogen, or a substituted or unsubstituted alkyl, cycloalkyl, aryl or heterocyclic group or $R_{12}$ can combine with T or W to form a ring;

X is a substituted or unsubstituted aryl group or an electron-withdrawing group such as but not limited to: cyano [—CN], carbonyl [—CO—], sulfoxy [—SO—], sulfono [—$SO_2$—], phosphoxy [—PO—], and nitro [—$NO_2$];

Y is C, N, O or S;

a is 1 or when X is divalent a is 1 or 2;

b is 1 for all divalent substituents X, i.e. carbonyl, sulfoxy, sulfono, and phosphoxy and 0 for all monovalent substituents X, i.e. aryl, cyano, and nitro.

W is hydrogen, halogen, or a substituted or unsubstituted alkyl, cycloalkyl, aryl or heterocyclic group, or W can combine with T or $R_{12}$ to form a ring, w is 0 to 3 when Y is C, w is 0–2 when Y is N, and w is 0–1 when Y is O or S, when w is 2, the two W groups can combine to form a ring, and when w is 3, two W groups can combine to form a ring or three W groups can combine to form an aryl group or a tricyclic substituent.

Heterocyclic groups useful in compounds of Structure I and III are preferably a 5- or 6-membered heterocyclic rings containing one or more hetero atoms, such as N, O, S or Se. Such groups include for example substituted or unsubstituted benzimidazolyl, benzothiazolyl, benzoxazolyl, benzothiophenyl,benzofuryl, furyl, imidazolyl, indazolyl, indolyl, isoquinolyl, isothiazolyl, isoxazolyl, oxazolyl, picolinyl, purinyl, pyranyl, pryazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, and triazolyl groups.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems. Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched, unbranched or cyclic.

The following are representative examples of compounds of Structure III:
| Structure |
|---|
| D-1 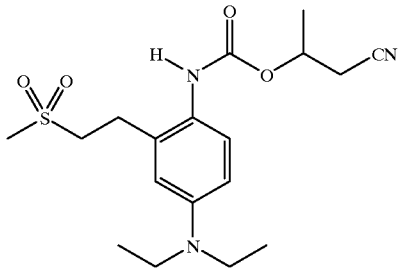 |
| D-2 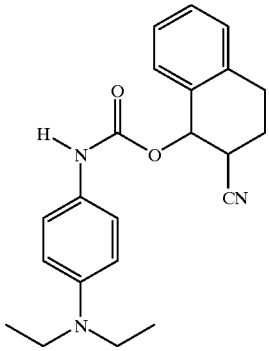 |
| D-3 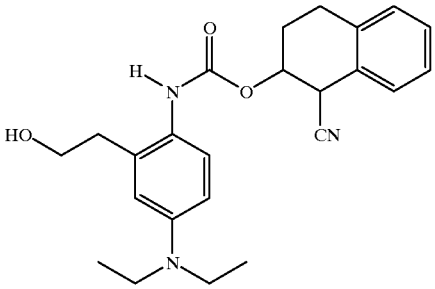 |
| D-4 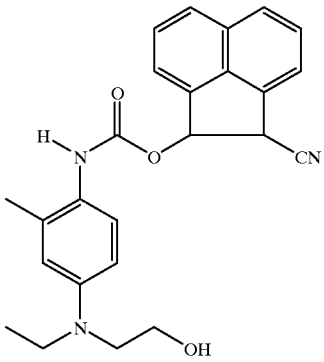 |

-continued
| Structure |
|---|
| D-5 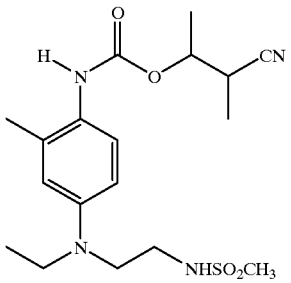 |
| D-6 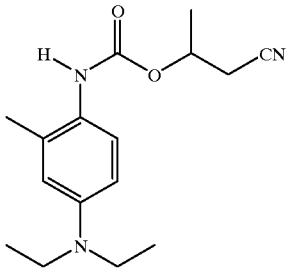 |
| D-7 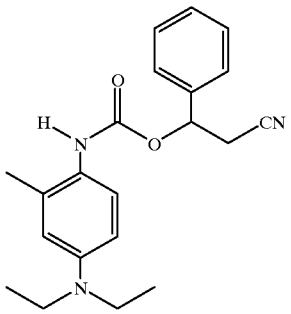 |
| D-8 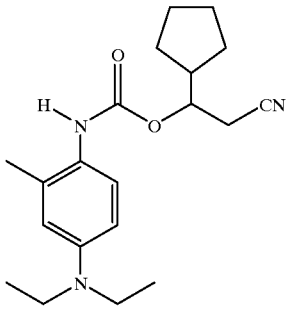 |
| D-9 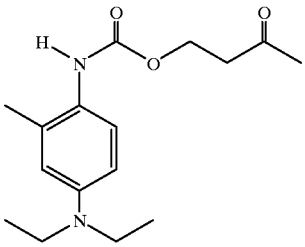 |

-continued
| | Structure |
|---|---|
| D-10 | 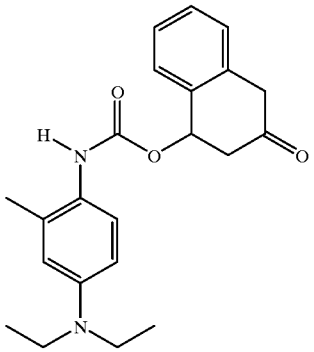 |
| D-11 | 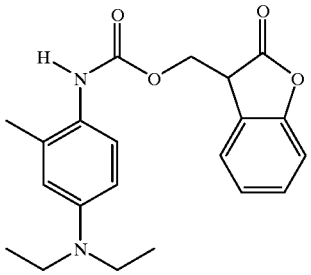 |
| D-12 | 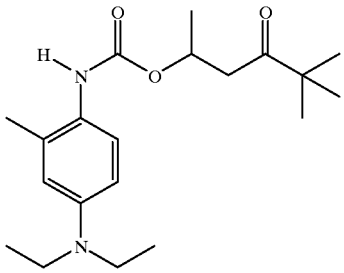 |
| D-13 | 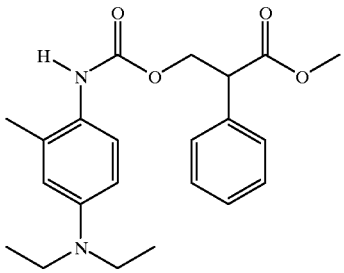 |
| D-14 | 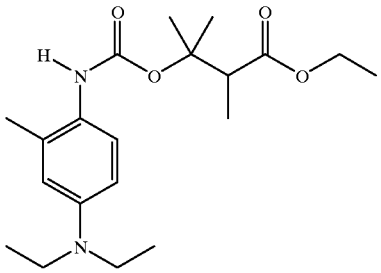 |

-continued
| | Structure |
|---|---|
| D-15 | 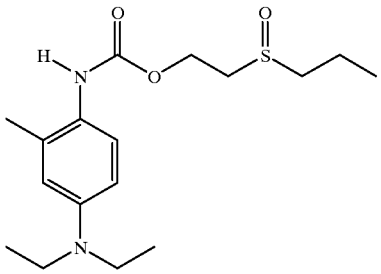 |
| D-16 | 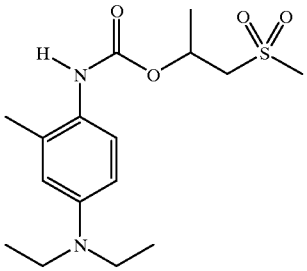 |
| D-17 | 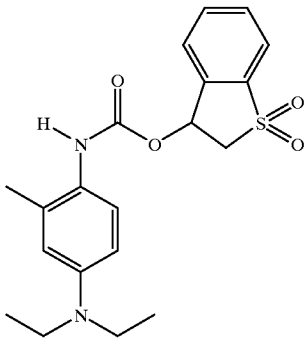 |
| D-18 | 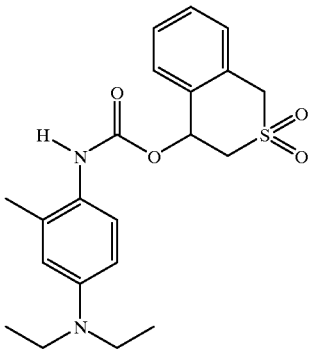 |

-continued
| Structure |
|---|
| D-19 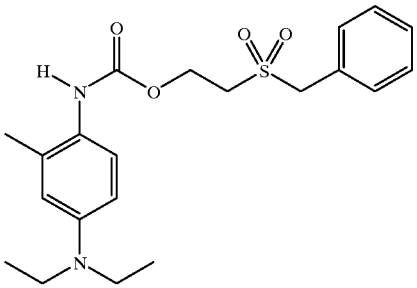 |
| D-20 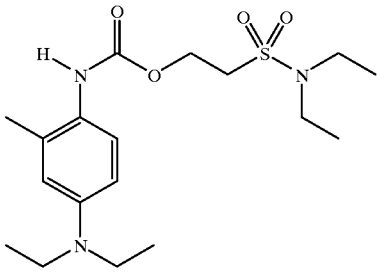 |
| D-21 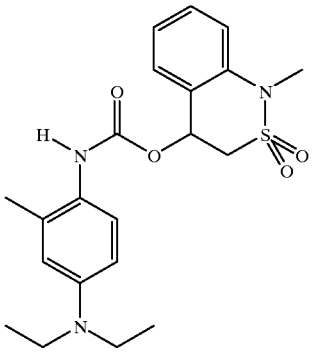 |
| D-22 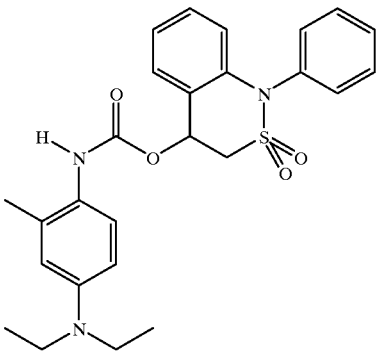 |

-continued
| Structure |
| --- |
| D-23 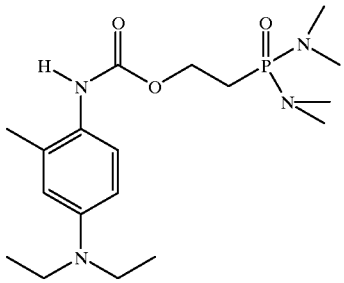 |
| D-24 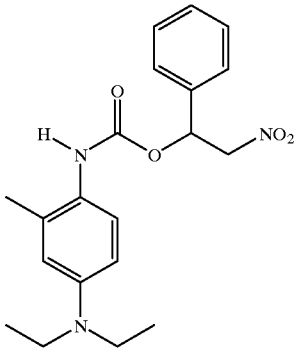 |
| D-25 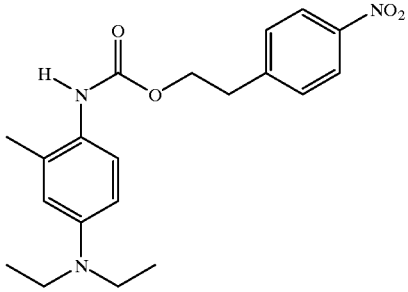 |
| D-26 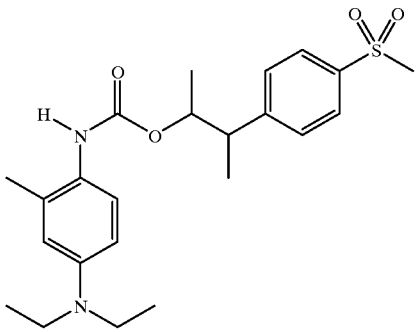 |

-continued
| Structure |
|---|
| D-27 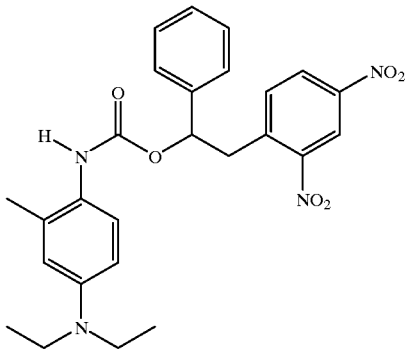 |
| D-28 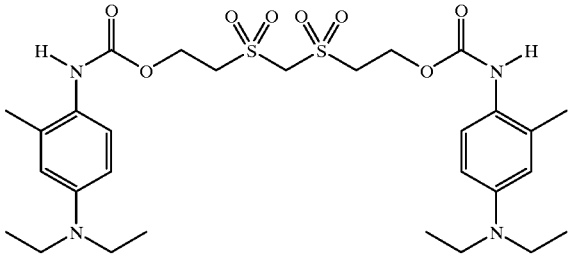 |
| D-29 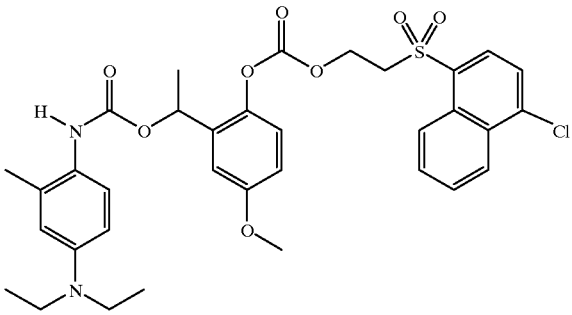 |
| D-30 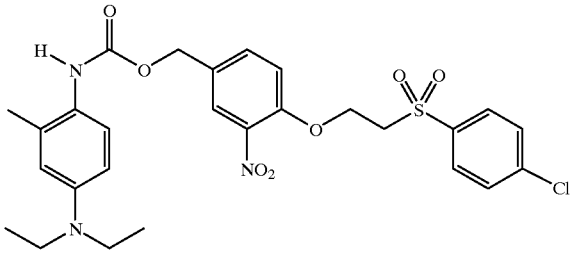 |
| D-31 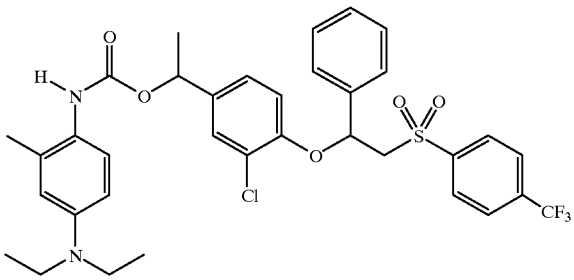 |

-continued

| Structure |
|---|
| D-34 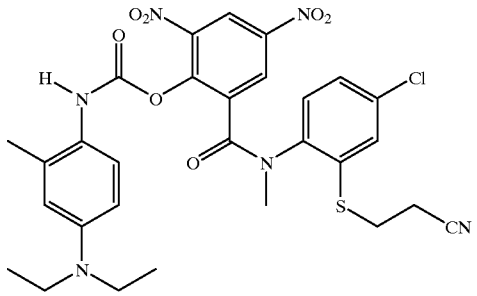 |
| D-35 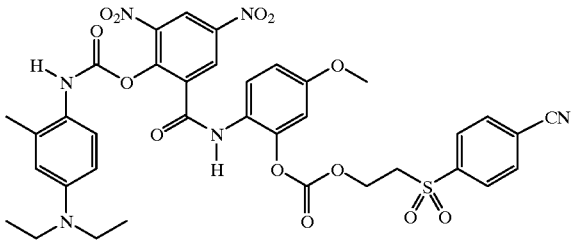 |
| D-36 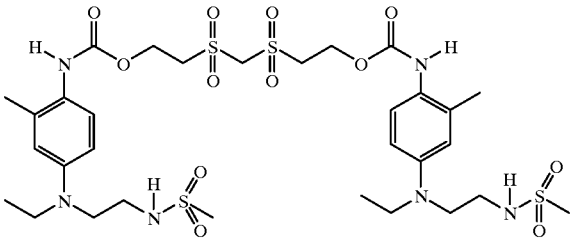 |
| D-37 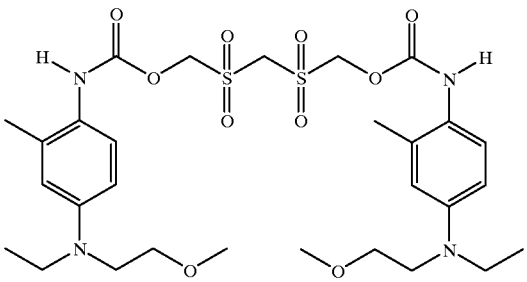 |

The blocked developing agent is preferably incorporated in one or more of the imaging layers of the imaging element. The amount of blocked developing agent used is preferably 0.01 to 5 g/m$^2$ more preferably 0.1 to 2 g/m$^2$ and most preferably 0.3 to 2 g/m$^2$ in each layer to which it is added. These may be color forming or non-color forming layers of the element. The blocked developing agent can be contained in a separate element that is contacted to the photographic element during processing.

After image-wise exposure of the imaging element, the blocked developing agent can be activated during processing of the imaging element by the presence of acid or base in the processing solution, by heating the imaging element during processing of the imaging element, and/or by placing the imaging element in contact with with a separate element, such as a laminate sheet, during processing. The laminate sheet optionally contains additional processing chemicals such as those disclosed in *Research Disclosure I*, Sections XIX and XX. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

In the photographic element of the present invention, the blocked developing agent is incorporated in a photothermographic element which can be one of various types. However, in reference to Research Disclosure 17029 (Research Disclosure I), the photothermographic element may be of type A, but not Type B. A typical photothermographic element comprises in reactive association photosensitive silver halide and a reducing agent or developing agent. In these systems, development occurs by reduction of silver ions in the photosensitive silver halide to metallic silver.

The photographic element can comprise one or more light sensitive (photographic) layers and one or more non-photographic layers. Multicolor elements typically contain dye image-forming units sensitive to various regions of the electromagnetic spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to various regions of the electromagnetic spectrum can be disposed as a single segmented layer.

A typical multicolor photographic element comprises a support bearing a dye image-forming unit comprised of at least one red-sensitive silver halide emulsion layer having associated therewith at least one dye-forming coupler, a dye image-forming unit comprising at least one green-sensitive silver halide emulsion layer having associated therewith at least one dye-forming coupler, and a dye image-forming unit comprising at least one blue-sensitive silver halide emulsion layer having associated therewith at least one dye-forming coupler. The element can contain additional layers, such as filter layers, inter-layers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

It is also contemplated that, in alternative embodiments, the photographic element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed. Cameras may contain a built-in processing capability, for example a heating element.

In the following discussion of suitable materials for use in elements of this invention, reference will be made to *Research Disclosure*, September 1996, Number 389, Item 38957, which will be identified hereafter by the term "Research Disclosure II." The Sections hereafter referred to, in the following description, are Sections of the Research Disclosure II unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference. Elements suitable for use in the proposed system are also found in *Research Disclosure I* and *Research Disclosure*, June 1978, Item No. 17643. These references are also incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing) Suitable emulsions and their preparation as well as methods of chemical and spectral sensitization are described in Research Disclosure II, Sections I through V. Color materials and development modifiers are described in Research disclosure II, Sections V through XX. Vehicles which can be used in the photographic elements are described in Research disclosure II, Section II, and various additives such as brighteners, antifoggants, stabilizers, light absorbing and scattering materials, hardeners, coating aids, plasticizers, lubricants and matting agents are described, for example, in Research disclosure II, Sections VI through XIII. Manufacturing methods are described in all of the sections, layer arrangements particularly in Research disclosure II, Section XI, exposure alternatives in Research disclosure II, Section XVI, and processing methods and agents in Research disclosure II, Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or anti-halation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography,"

C. R. Barr, J. R. Thirtle and P. W. Vittum in *Photographic Science and Engineering*, Vol. 13, p. 174 (1969), incorporated herein by reference.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111 } major faces. Emulsions containing {111} major face tabular grains, including those with controlled grain dispersities, halide distributions, twin plane spacing, edge structures and grain dislocations as well as adsorbed {111 } grain face stabilizers, are illustrated in those references cited in Research Disclosure II, Section I.B.(3) (page 503).

The silver halide grains to be used in the invention may be prepared according to methods known in the art, such as those described in Research Disclosure II and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing photographic speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure II*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure II*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure II* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure II*, Section IV (pages 510–511) and the references cited therein.

The silver halide may be sensitized by sensitizing dyes by any method known in the art, such as described in *Research Disclosure II*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

The photothermographic element can comprise a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, and salicylanilide Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The photothermographic element can comprise a variety of supports. Examples of useful supports are poly (vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the thermal processing temperatures.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Photographic elements of the present invention are preferably imagewise exposed using any of the known techniques, including those described in *Research Disclosure II*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

The present invention will be better understood with reference to the following examples,which are for illustrative purposes only, not to be construed to limit the claims.

EXAMPLE 1

This example illustrates the synthesis of a representative blocked developing agent useful in the invention. This compound is referred to above as blocked developing agent D-16, and is prepared according to the following reaction scheme:

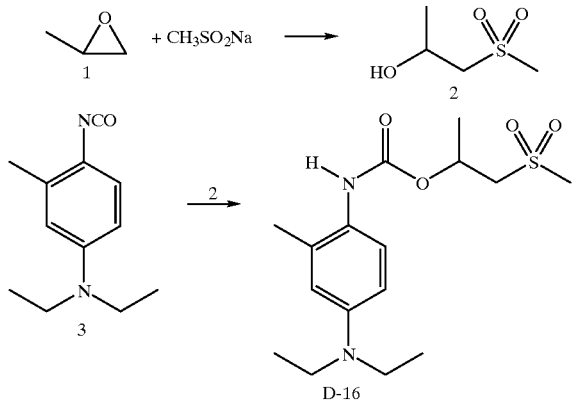

Propylene oxide (1, 7.2 mL, 105 mmol), sodium methanesulfinate (9.19 g, 90 mmol), and monobasic sodium phosphate monohydrate (16.56 g) were heated in 100 mL of water at 90° C. for 18 h. The solution was cooled and extracted with 4×100 mL of ethyl acetate. The extracts were dried over sodium sulfate and concentrated to a solid. The yield of 2 was 6.42 g (46 mmol, 52%).

A solution of 2 (3.32 g, 24 mmol), compound 3 (4.08 g, 20 mmol), and dibutyltin diacetate (0.05 miL) in 60 mL of 1,2-dichloroethane was stirred at room temperature for 7 days. The crude reaction mixture was purified by column chromatography on silica gel. The yield of D-16 was 6.15 g (18 mmol, 90%), m.p. 80–82° C., ESMS: ES+m/z 343 (M+1, 100%).

EXAMPLE 2

This example illustrates the synthesis of a representative blocked developing agent useful in the invention. This compound is referred to above as blocked developing agent D-17, and is prepared according to the following reaction scheme:

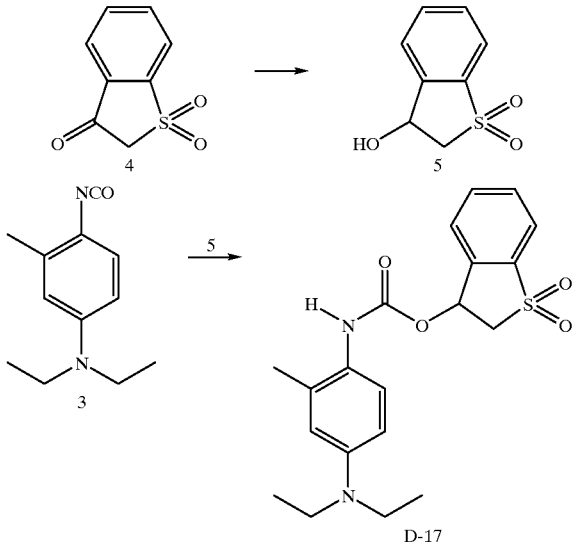

Sodium borohydride (3.95 g, 104 mmol) was added in portions at room temperature over a period of 45 min to a suspension of compound 4 (9.11 g, 50 mmol) in methanol (150 mL). Water (50 mL) was added and methanol was distilled off. The residue was extracted with ether; the extracts were dried over sodium sulfate and concentrated to an oil. The yield of 5 was 8.85 g (48 mmol, 96%).

A solution of 5 (4.05 g, 22 mmol), 3 (4.08 g, 20 mmol), and 0.05 mL of dibutyltin diacetate in dichloromethane (20 mL) was stirred at room temperature for 20 h. The reaction mixture was diluted with ether (100 mL) and worked up with water giving a crude product which was purified by column chromatography on silica gel. The yield of D-17 was 5.49 g (14 mmol, 71%), m.p. 149–151° C., ESMS: ES+m/z 389 (M+1, 100%), ES-m/z 387 (M−1, 35%).

EXAMPLE 3

This example illustrates the synthesis of a representative blocked developing agent useful in the invention. This compound is referred to above as developing agent D-28, and is prepared according to the following reaction scheme:

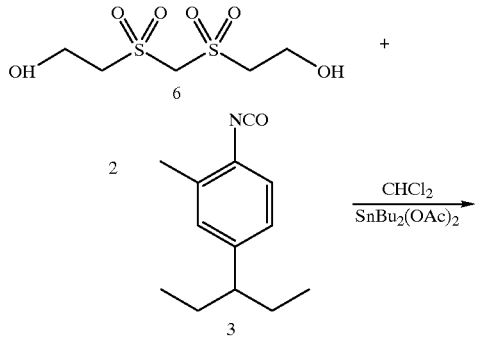

-continued

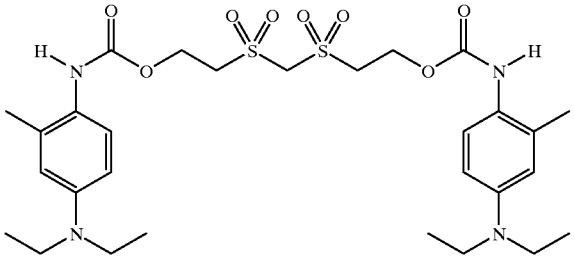

Compounds 2 and 6 are commercially available. Dibutyltin diacetate is also commercially available. The crude reaction mixture can be purified by column chromatography on silica gel. The resulting Compound D-28 is thusly obtained in good yield.

EXAMPLE 4

The silver halide emulsion used in Example 5 comprises silver iodobromide tabular grains precipitated by conventional means as known in the art. Table 1 below lists the various emulsions, along with their iodide content (the remainder assumed to be bromide), their dimensions, and the sensitizing dyes used to impart spectral sensitivity. All of these emulsions have been given chemical sensitizations as known in the art to produce optimum sensitivity.

TABLE 1

| Emulsion | Spectral sensitivity | Iodide content (%) | Diameter (μm) | Thickness (μm) | Dyes |
|---|---|---|---|---|---|
| E-1 | Yellow | 3.0 | 0.60 | 0.09 | SY-1 |

The color dispersion used in Example 5 is referred to as Coupler Dispersion CDC-2, which is an oil based coupler dispersion was prepared by conventional means containing coupler C-2 and dibutylphthalate at a weight ratio of 1:1.

| No. | Structure |
|---|---|
| DC-3 | 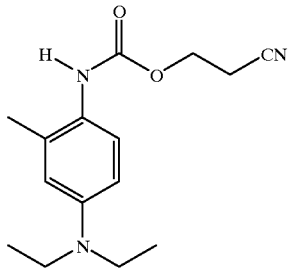 |
| DC-4 | 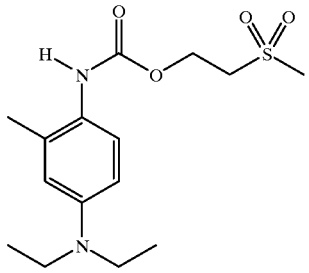 |

-continued

| No. | Structure |
|---|---|
| C-2 | 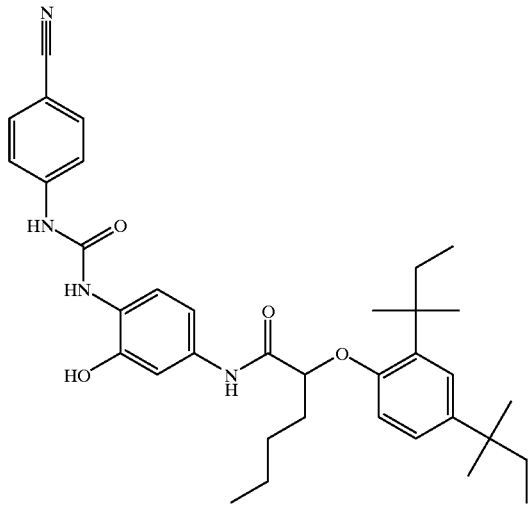 |
| SY-1 | 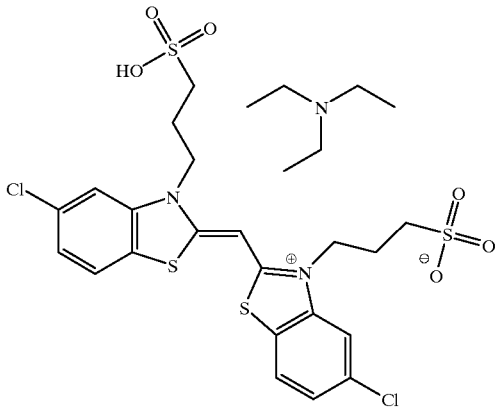 |
| Hardener-1 | 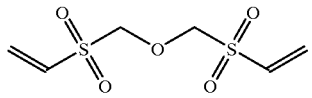 |
| Antifoggant AF-1 | 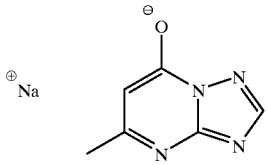 |

EXAMPLE 5

This example illustrates coatings for a photographic element containing a single light sensitive layer, with variations consisting of changing the incorporated developer. All coatings were prepared on a 7 mil thick poly(ethylene terephthalate) support. Developers were ball-milled in an aqueous slurry for 3 days using Zirconia beads in the following formula. For 1 g of incorporated developer, sodium tri-isopropylnaphthalene sulfonate (0.2 g), water (10 g), and beads (25 ml). Following milling, the zirconia beads were removed by filtration. The slurry was refrigerated prior to use.

The coating example was prepared according to the format listed in Table 2 below. Four developers of this invention were evaluated. The formulation was coated on a 7 mil thick poly(ethylene terephthalate) support.

TABLE 2

| Component | Laydown |
|---|---|
| Silver (from emulsion E-1) | 0.86 $g/m^2$ |
| Coupler C-2 (from coupler dispersion CDC-2) | 1.08 $g/m^2$ |
| Developer | 0.86 $g/m^2$ |

TABLE 2-continued

| Component | Laydown |
|---|---|
| Antifoggant AF-1 | 15 mg/m$^2$ |
| Hardener 1 | 58 mg/m$^2$ |
| Lime processed gelatin | 3.23 g/m$^2$ |

The resulting coatings were exposed through a step wedge to a 2.40 log lux light source at 5500K and Wratten 2B filter. The exposure time was 1/50 second. After exposure, the coating was soaked in Activator A or B for 15 seconds and laminated to a passive coating containing 1.08 g/m$^2$ of gelatin. The film package was then processed by contact with a heated platen for 10 seconds and evaluated for image. A negative cyan colored dye image was observed for blocked color developers D-28, D-36, and D-37. The results are summarized in Table 3 below. The density measured for each coating was Status M red density.

Activator A: (concentrations by weight in distilled water)

2.65% sodium carbonate 0.63% sodium bicarbonate 0.1% sodium bromide 0.2% sodium sulfite Activator B: 74.5 g/L KOH 8 g/L potassium sulfite 2 g/L potassium bromide

TABLE 3

| Coating | Developer | Activator/time/temp. | $D_{max}$ |
|---|---|---|---|
| I-3-1 | D-28 | A/10"/70 C. | 0.53 |
| | | A/10"/90 C. | 1.40 |
| | | B/10"/50 C. | 0.40 |
| | | B/10"/70 C. | 2.25 |
| | | B/10"/90 C. | 4.92 |
| I-3-2 | D-36 | A/10"/50 C. | 0.09 |
| | | A/10"/70 C. | 0.89 |
| | | A/10"/90 C. | 1.20 |
| I-3-3 | D-37 | A/10"/70 C. | 0.92 |
| | | A/10"/90 C. | 0.56 |
| | | B/10"/70 C. | 0.43 |
| | | B/10"/90 C. | 1.26 |

EXAMPLE 6

Measurements were performed in a model system to study the unblocking kinetics of some blocked developers used in this invention. Two separate techniques were used to obtain information on these kinetics:

1. A 0.1 mM solution of blocked developer D-n in methyl sulfoxide (DMSO, Aldrich Anhydrous 99.8+%) is heated at 130° C., or other set temperatures, under a nitrogen atmosphere. Disappearance of the blocked developer is followed by taking out aliquots at different time intervals, quickly cooling in a cold water bath, and analyzing with high pressure liquid chromatography (HPLC). Half-lives ($t_{1/2}$) for the deblocking reaction are then obtained.

2. Monitoring the thermolysis reaction can also be done by detecting the released color developer. Aliquots of the reacting solution in DMSO are taken and the released color developer converted to dye with coupler C-3 at pH 10. Dye amount is quantified in 1-cm cells at ~568 nm with a spectrophotometer, and rate constants for the reaction can be obtained.

Representative results are given in Table 4 below. It can be seen that the blocked developers of this invention yield lower values of $t_{1/2}$ with either detection method than do comparative examples. The lower value of $t_{1/2}$ indicates a more active developer which is desirable.

TABLE 4

| Blocked Developer | $t_{1/2}$, min Method 1 | $t_{1/2}$, min Method 2 | $t_{1/2}$, min Average |
|---|---|---|---|
| DC-3 (comparative) | 6.83 | 7.60 | 7.22 |
| DC-4 (comparative) | 20.16 | 18.2 | 19.18 |
| D-6 (inventive) | 0.944 | 0.893 | 0.919 |
| D-16 (inventive) | 0.587 | 0.722 | 0.655 |
| D-28 (inventive) | — | 0.45 | — |

The term "DMSO thermal stability test" herein refers to the average value of $t_{1/2}$ by Method 1 and Method 2.

EXAMPLE 7

This example illustrates the preparation of a multi-layer color photographic element, with a blocked developing agent, according to the present invention, together with the preparation of the same photographic element without the blocked developing agent. (All quantities are given in g/m$^2$ unless otherwise noted.) The light sensitive emulsions were stabilized with tetraazaindene. The samples further comprised hardener, surfactants, antioxidants, stabilizers, UV absorbers, matte agents, slipping agents and such all as known in the art. The couplers were supplied as oil-in-water dispersions.

Comparative Photographic Sample C-1 was formed by sequentially applying to a transparent support having an antihalation layer:

Red light sensitive layer (layer-1): gelatin at 1.72; cyan dye-forming coupler C-1 at 0.47; coupler C-3 at 0.03; a red light sensitized AgIBr emulsion having 1.7 mol % iodide exhibiting an equivalent circular diameter (ecd) of 0.55 microns and a thickness (t) of 0.083 microns at 0.16; a red light sensitized AgIBr emulsion having 4.1 mol % iodide, 0.66 microns×0.12 microns at 0.22; a red light sensitized AgIBr emulsion having 4.1 mol % iodide, 1.3 microns×0.12 microns at 0.22; and a red light sensitized AgIBr emulsion having 3.7 mol % iodide, 2.6 microns×0.12 microns at 0.22.

Interlayer (layer-2): gelatin at 1.07; and scavenger S-1 at 0.11.

Green light sensitive layer (layer-3): gelatin at 1.51; magenta dye-forming coupler M-1 at 0.52; coupler M-2 at 0.03; green light sensitized AgIBr emulsion having 2.6 mol % iodide, 0.81 microns×0.12 microns at 0.16; green light sensitized AgIBr emulsion having 4.1 mol % iodide, 1 microns×0.12 microns at 0.22; green light sensitized AgIBr emulsion having 4.1 mol % iodide, 1.2 microns×0.11 microns at 0.22; and green light sensitized AgIBr emulsion having 3.7 mol % iodide, 2.6 microns×0.12 microns at 0.22.

Yellow filter layer (layer-4): gelatin at 1.07; scavenger S-1 at 0.11; and yellow filer dye YFD-1 at 0.11 as a solid particle dispersion.

Blue light sensitive layer (layer-5): gelatin at 1.35; yellow dye-forming coupler Y-1 at 0.46; coupler Y-2 at 0.03; blue light sensitized AgIBr emulsion having 1.5 mol % iodide, 0.55 microns×0.83 microns at 0.16; blue light sensitized AgIBr emulsion having 1.5 mol % iodide, 0.77 microns×0.14 microns at 0.22; blue light sensitized AgIBr emulsion having 4.1 mol % iodide, 1.3 microns×0.14 microns at 0.22; and blue light sensitized AgIBr emulsion having 9 mol % iodide, 1 microns×0.35 microns at 0.22.

Protective overcoat (layer-6): gelatin at 0.97; UV absorbing dyes at 0.11; soluble matte beads at 0.005; and permanent matte beads at 0.11.

Inventive photographic sample 2 was like comparative photographic sample C-1 except that latent paraphenylenediamine color developing agent D-28, dispersed as a solid particle dispersion was added to the interlayer (layer-2) at 0.85 and to the yellow filter layer (layer-4) at 0.85.

Inventive photographic sample 3 was like comparative photographic sample C-1 except that latent paraphenylenediamine color developing agent D-28, dispersed as a solid particle dispersion was added to the red light sensitive layer (layer-1) at 0.57; to the green light sensitive layer (layer-3) at 0.57; and to the blue light sensitive layer (layer-5) at 0.57.

The following components were used:

C-1

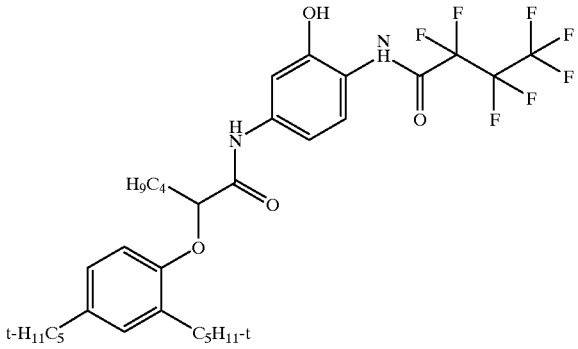

C-3

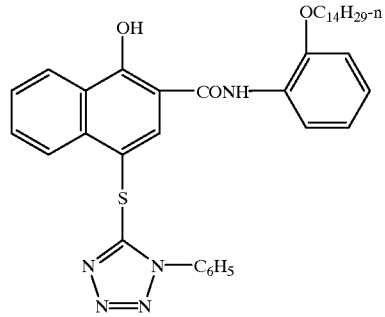

Y-2

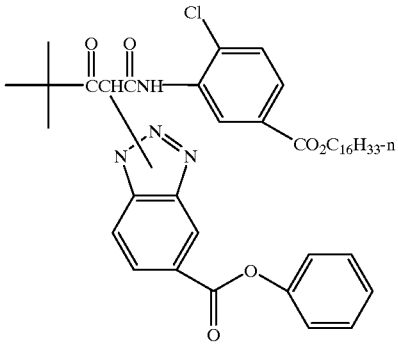

YFD-1

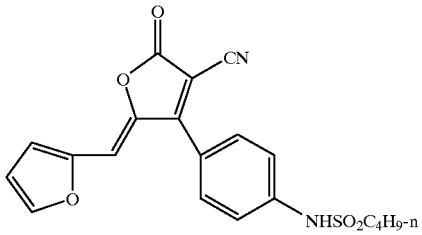

M-1

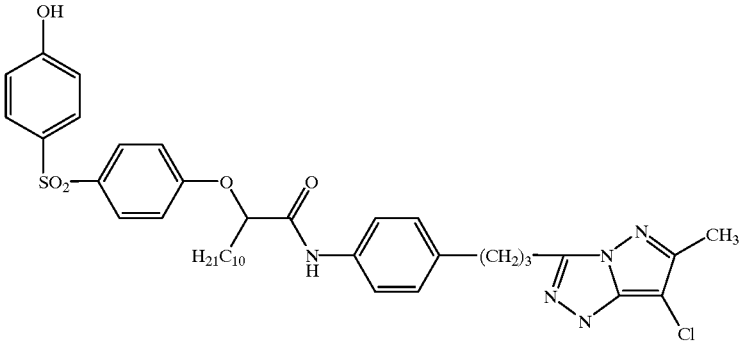

M-2

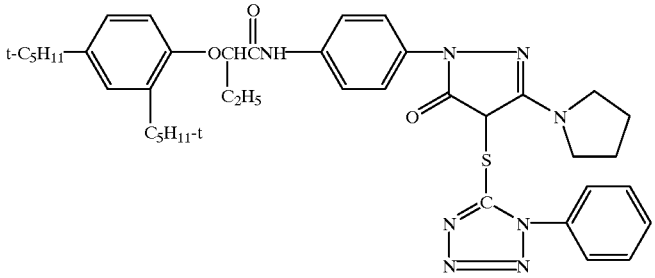

-continued

Y-1

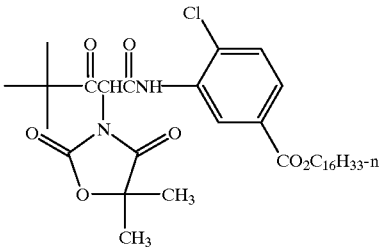

S-1

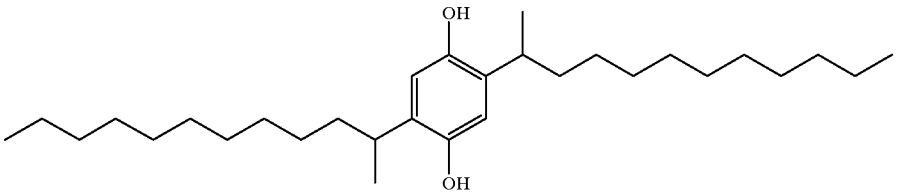

EXAMPLE 8

Wet-chemical photographic processing of Samples C-1, 2 and 3 were carried out as follows. Portions of samples C-1, 2 and 3 were exposed to white light through a graduated density test object and processed according to Process C-41 as described in the British journal of Photography Annual for 1988 at pages 196–198 but with a modified bleach solution having 1,3-propylenediamine tetra-acetic acid. The processed elements exhibited ISO sensitivities in excess of ISO-200 and formed excellent density in all color records.

Table 5 below shows a comparison of the lamba and density values for the three samples.

TABLE 5

| Measurement* | Sample N = C-1 | Sample N = 2 | Sample N = 3 |
|---|---|---|---|
| Red $\lambda_{max}$ | 668 | 668 | 668 |
| Green $\lambda_{max}$ | 556 | 558 | 554 |
| Blue $\lambda_{max}$ | 452 | 452 | 452 |
| Red $\lambda_{max\ N}/\lambda_{max\ 1}$ | 1.000 | 1.000 | 1.000 |
| Green $\lambda_{max\ N}/\lambda_{max\ 1}$ | 1.000 | 1.004 | 0.996 |
| Blue $\lambda_{max/N}\lambda_{max\ 1}$ | 1.000 | 1.000 | 1.000 |
| Red D | 0.57 | 0.60 | 0.60 |
| Green D | 0.83 | 0.89 | 0.84 |
| Blue D | 0.52 | 0.53 | 0.47 |
| Red $DX_N/D_1$ | 1.00 | 1.05 | 1.05 |
| Green $D_N/D_1$ | 1.00 | 1.07 | 1.01 |
| Blue $D_N/D_1$ | 1.00 | 1.02 | 0.90 |

*Status M density was measured at step 11 of the neutral wedge exposure. Status M density is referenced in ISO 5 "Determination of Diffuse Transmission Density", as well as ANSI PH2.27-1979.

EXAMPLE 9

This example illustrates photographic wet-chemical processing of film according to the present invention, together with a comparison to conventional film. Portions of samples C-1, 2 and 3 were slit to camera loadable width and used to photograph a scene. The scene-exposed samples were then processed according to Process C-41 as described in processing example 8 above. In one variant, the processed samples bearing a record of the photographed scene were optically printed onto color paper as known in the art to produce excellent images. In another variant, the processed samples bearing a record of the photographed scene were, scanned, digitized, digitally corrected for color and tone scale, digitally edited, viewed using a soft display, stored and later printed using a digitally driven printer The image was scanned with a Nikon LS2000 film scanner. The digital image file obtained was loaded into Adobe Photoshop® (version 5.0.2) where corrections were made digitally to modify tone scale and color saturation, thus rendering an acceptable image. The image was viewed as softcopy by means of a computer monitor. The image file was then sent to a Kodak 8650® dye sublimation printer to render a hardcopy output of acceptable quality. This demonstrates the use of an element containing the inventive compounds in a complete imaging chain. Excellent images were obtained.

EXAMPLE 10

Various laminants for use in the present invention were prepared as follows: Laminant-1 was prepared by applying a hardened gelatin layer (17.2 g) to a clear support. Laminant-2 is prepared by applying a hardened gelatin layer (19.4 g) containing sodium picolinate at 6.46 g to a clear support.

EXAMPLE 11

This example illustrates thermal processing of film according to the present invention, including a comparison to a conventional film. Portions of samples C-1 (no blocked developing agent), 2 (blocked developing agent in an interlayer) and 3 (blocked developing agent in the emulsion) were slit to camera loadable width and used to photograph a scene. The scene exposed samples were then processed by first immersing the samples for 15 seconds in a solution of 5% KOH, 0.1% NaBr, 0.2% NaSO3, 0.1% 5-methyl benzotriazole, and 0.14% Triton-X in water at room temperature, followed by laminating with laminant-1, heating to 70° C. for 10 seconds, to prevent evaporation and to protect the wet film, and then delaminating. No image was formed in sample 1. Sample 1 lacked the incorporated latent color developing agent. Excellent images were formed in samples 2 and 3, both of which included the latent color developing agent. The processed samples bearing a record of the photographed scene were, scanned, digitized, digitally corrected for color and tone scale, digitally edited, viewed using a soft display, stored and later printed using a digitally driven printer to again form excellent images.

EXAMPLE 12

In another embodiment, excellent color images can be obtained by preparing the following photographic elements and treating them by the following method. Photographic sample 6 was prepared like photographic sample 2 except that an additional layer (base release layer-7) was superimposed on protective layer-6. Base release layer-7 comprised 6.46 g of zinc hydroxide in 9.47 g of gelatin.

A portions of sample 6 was slit to camera loadable width and used to photogaraph a scene. The scene-exposed sample was then processed according to Process C-41 as described in processing Example 8 above. The processed sample bearing a record of the photographed scene was scanned, digitized, digitally corrected for color and tone scale, digitally edited, viewed using a soft display, stored and later printed using a digitally driven printer to form excellent images.

A portion of sample 6 was slit to camera loadable width and employed in a camera to photograph a scene. The scene exposed samples were then processed by first treating the samples with water at room temperature, laminating with laminant-2, heating to 70° C. for 15 seconds, and delaminating. The imagewise exposed and developed portion of sample 6, each bearing a record of the photographed scene, were then scanned, digitized, digitally corrected for color and tone scale, digitally edited, viewed using a soft display, stored and printed using a digitally driven printer to again form excellent viewable images.

EXAMPLE 13

Preparative photographic sample 2 was processed in accordance with photographic processing examples 9 and 11. An area from a neutral density portion of the negative image was placed into a Perkin-Elmer spectrophotometer and measured for spectral absorbance over visible wavelengths. The data in the following table list the peak absorbance from the dyes formed in the red, green, and blue portions of the spectrum. The dyes formed from the two processes are superimposable to within 12 nm.

TABLE 6

| Process | red peak, nm | green peak, nm | blue peak, nm |
|---|---|---|---|
| Example 9 process | 666 | 552 | 440 |
| Example 11 process | 668 | 556 | 452 |

COMPARATIVE EXAMPLE 14

This example illustrates the preparation of a photographic element for comparison to the present invention. (All quantities are given in g/m$^2$ unless otherwise noted.) A tabular silver halide emulsion having 3.0 mol % iodide exhibiting an equivalent circular diameter of 0.60 microns and a thickness of 0.09 microns was coated at 0.65. Cyan dye-forming coupler C-2 was coated at 0.65 and gelatin at 6.1. Comparative compound B, prepared as a ball milled dispersion was coated at 0.94. The sample further comprised hardener, surfactants, antioxidants, and stabilizers as known in the art.

COMPARATIVE EXAMPLE 15

This example illustrates the preparation of another photographic element for comparison to the present invention. Comparative sample 15 was like comparative sample 14 with the exception that compound C, prepared as an oil dispersion in hexanoic acid, 2-ethyl-, 1,4-cyclohexanediylbis(methylene) ester, was coated equimolar to compound B at 1.56.

EXAMPLE 16

This example illustrates the preparation of a photographic element according to the present invention. This inventive sample 16 was like comparative sample 14 with the exception that latent paraphenylenediamine color developer D-28, prepared as a ball milled dispersion, was coated equimolar to compound B at 0.65.

C

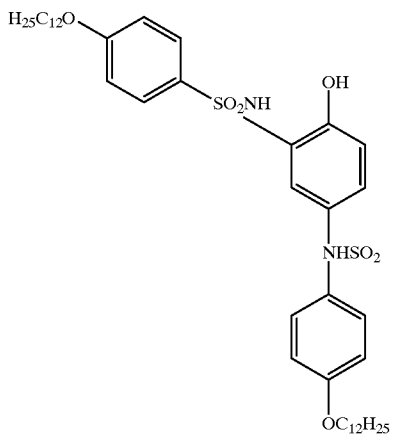

B

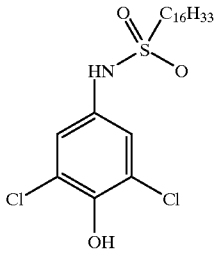

Samples 14, 15, and 16 were exposed to white light through a graduated density test object and processed according to Process C-41 as described in photographic processing example 8. Spectrophotometry was performed on the samples with absorption peaks measured in the visible portion of the spectrum. The results are summarized in the following Table 7.

TABLE 7

| Sample | Compound | peak 1, nm. | peak 2, nm |
|---|---|---|---|
| 14 | B | — | 698 |
| 15 | C | 382 | 696 |
| 16 | D-28 | — | 698 |

Samples 14, 15, and 16 were exposed to white light through a graduated density test object. The exposed samples were then processed by first treating the samples with a solution of 5% sodium carbonate and 0.1% Triton® X 200E surfactant in water at room temperature. The coatings were then laminated to laminant-1, heated to 70° C. for 15 seconds, delaminated, then bleached and fixed according to Process C-41. Spectrophotometry was performed on the samples with absorption peaks measured in the visible portion of the spectrum. Samples 14 and 15 did not produce visible density. The results are summarized in the following table.

TABLE 8

| Sample | Compound | Peak 1, nm. | Peak 2, nm |
|---|---|---|---|
| 14 | B | No density | no density |
| 15 | C | No density | no density |
| 16 | D-28 | — | 696 |

The invention has been described in detail with particular reference to preferred embodiments, but it will be understood that variations and modifications can be effected within the spirit and scope of the invention.

What is claimed is:

1. A method of processing color photographic film that has been imagewise exposed in a camera, said film having at least three light-sensitive unit which have their individual sensitivities in different wavelength regions, each of the units comprising at least one light-sensitive silver-halide emulsion, binder, and dye-providing coupler, wherein the method comprises:

(a) a color development step comprising contacting the imagewise exposed color photographic film with a developing agent comprising a non-blocked p-phenylenediamine developing agent, under agitation at a temperature of 30 to 50° C., in order to form a color negative image in the film by reaction of the non-blocked p-phenylenediamine developing agent with the dye-providing couplers inside the silver-halide emulsions, the dyes formed from the dye-providing couplers in the three light-sensitive units being different in hue, (b) desilvering said film in one or more desilvering solutions to remove unwanted silver and silver halide, thereby forming a color negative image; and (c) forming a positive-image color print from the desilvered film;

wherein said film further comprises an internally located blocked developing agent in reactive association with each of said three light-sensitive layers such that the blocked developing agent is substantially unreactive in the color development step (a) above, but wherein color development of the same imagewise exposed film is capable of being alternatively and comparatively obtained, without any externally applied developing agent, by heating said film to a temperature above about 50° C. under aqueous conditions, such that the blocked developing agent then becomes unblocked to form a phenylenediamine developing agent, whereby the unblocked developing agent forms dyes by reacting with the dye-providing couplers inside the silver-halide emulsions, the dyes thus formed from the dye-providing couplers in the three light-sensitive units being different in hue.

2. A method of processing a commercial quantity of color photographic film sold to camera users over a given period of time, which film has been imagewise exposed in a camera, said film having at least three light-sensitive units which have their individual sensitivities in different wavelength regions, each of the units comprising at least one light-sensitive silver-halide emulsion, binder, and dye-providing coupler, wherein the method comprises:

(a) processing a substantial portion of said quantity of film in a color development step comprising contacting the imagewise exposed color photographic film with a developing agent comprising a non-blocked p-phenylenediamine developing agent, under agitation at a temperature of 30 to 50° C. under aqueous alkaline conditions, in order to form a color negative image in the film by reaction of the non-blocked p-phenylenediamine developing agent with the dye-providing couplers inside the silver-halide emulsions, the dyes formed from the dye-providing couplers in the three light-sensitive units being different in hue, followed by desilvering said film in one or more desilvering solutions to remove unwanted silver and silver halide, thereby forming a color negative image; and thereafter forming a positive-image color print from the desilvered film;

(b) processing a substantial portion of said quantity of film in a color development step without any externally applied developing agent, comprising heating said film to a temperature above about 50° C. aqueous conditions, such that an internally located blocked developing agent in reactive association with each of said three light-sensitive units becomes unblocked to form a phenylenediamine developing agent, whereby the unblocked developing agent forms dyes by reacting with the dye-providing couplers to form a comparable color negative image, which color image may be scanned, without desilvering, to provide a digital electronic record of the color image capable of generating a positive color image in a display element.

3. The method of claim 2, wherein the color image is generated by thermal-diffusion or ink-jet printing.

4. The method of claim 2, wherein the consumer who submits the film for development makes the choice of either color development (a) or (b) to be used by the film processor.

5. The method of claim 2, wherein alkaline or acidic conditions are produced in the photographic element by means of a laminate that provides a source of externally supplied chemical base or acid for diffusion transfer to the film during color development.

6. The method of claim 2 wherein acidic or alkaline conditions is produced in the photographic element by means of a low-volume activating solution.

7. The method of claim 6, wherein the low volume activating solution is between about 0.1 to about 10 times the volume of solution required to swell the film.

8. The method of claim 2, wherein the internally located blocked developing agent remains substantially blocked in the presence of the non-blocked developing agent and under the process conditions of step (a) such that the blocked developing agent does not competitively react with the dye-providing couplers inside the silver-halide emulsions.

9. The method of claim 1, wherein the blocked developing agent comprises a group having the following structure:

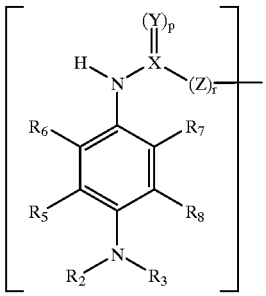

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring;

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0.

10. The method of claim 2, wherein the non-blocked developing agent is a compound, or a photographically compatible salt form thereof, selected from the group consisting of:

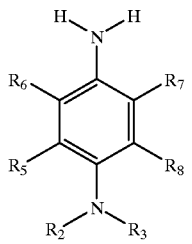

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring.

11. The method of claim 2, wherein the blocked developing agent, after being unblocked, is the same compound as the non-blocked developing agent.

12. A method of forming a color image comprising:

(a) providing a photographic element comprising a support bearing a layer unit sensitive to a region of the electromagnetic spectrum, said layer unit comprising a binder, a light sensitive silver-halide emulsion, and a developing-agent precursor comprising the following group:

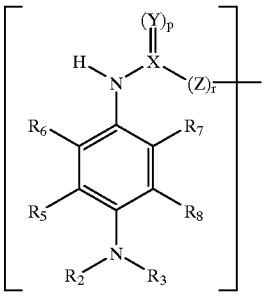

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring;

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

(b) imagewise exposing the photographic element to light; and (c) contacting the imagewise exposed element with a developer solution for between about 10 and 500 seconds at a temperature of below about 50° C., said developer solution having a pH greater than about 9 and comprising a color developer, whereby an imagewise density deposit is formed in the imagewise exposed element which imagewise density deposit has substantially no density contribution formed by release of a first developing agent by said developing-agent precursor.

13. A method according to claim 12, wherein the imagewise density deposit is changed no more than 20% at $\lambda_{max}$ by any release of the first developing agent by said developing-agent precursor.

14. A method according to claim 12 wherein said imagewise density deposit is a dye deposit.

15. A method according to claim 12 wherein the photographic element comprises a red light sensitive layer unit, a green light sensitive layer unit and a blue light sensitive layer unit.

16. A method according to claim 12 wherein the photographic element comprises a white light sensitive layer unit and two light sensitive layer units chosen from the group consisting of a red light sensitive layer unit, a green light sensitive layer unit and a blue light sensitive layer unit.

17. A method of forming a color image according to claim 12 wherein the imagewise exposed element is contacted with the developer solution for between about 10 and 200 seconds at a temperature of between about 30 and 50° C. and wherein the color developer is present at a concentration between about 5 and 30 mmol/liter.

18. A method according to claim 12 wherein the photographic element comprises an incorporated color filter array.

19. The method of claim 12 in which the photographic element further comprises a dye-providing coupler.

* * * * *